US010168659B2

(12) United States Patent
Kim

(10) Patent No.: US 10,168,659 B2
(45) Date of Patent: Jan. 1, 2019

(54) DEVELOPING UNIT TRANSFERRING DEVICE, IMAGE FORMING APPARATUS EMPLOYING THE DEVELOPING UNIT TRANSFERRING DEVICE, AND DEVELOPING UNIT SEPARATING METHOD OF THE IMAGE FORMING APPARATUS

(71) Applicant: S-Printing Solution Co., Ltd., Suwon-si (KR)

(72) Inventor: Hak-yun Kim, Gwangmyeong-si (KR)

(73) Assignee: HP PRINTING KOREA CO., LTD., Suwon-si (KR)

( * ) Notice: Subject to any disclaimer, the term of this patent is extended or adjusted under 35 U.S.C. 154(b) by 0 days.

(21) Appl. No.: 15/364,383

(22) Filed: Nov. 30, 2016

(65) Prior Publication Data

US 2017/0176923 A1 Jun. 22, 2017

(30) Foreign Application Priority Data

Dec. 22, 2015 (KR) ..... 10-2015-0184008

(51) Int. Cl.
*G03G 21/16* (2006.01)

(52) U.S. Cl.
CPC ..... *G03G 21/1647* (2013.01); *G03G 21/1676* (2013.01)

(58) Field of Classification Search
CPC ..... G03G 21/1676; G03G 21/1647; G03G 21/1842; G03G 21/1807
See application file for complete search history.

(56) References Cited

U.S. PATENT DOCUMENTS

| | | | | |
|---|---|---|---|---|
| 9,188,944 | B2 | 11/2015 | Park et al. | |
| 2011/0085822 | A1 | 4/2011 | Ishii | |
| 2012/0128387 | A1 | 5/2012 | Kim et al. | |
| 2014/0147164 | A1 | 5/2014 | Sakuma | |
| 2014/0193173 | A1 | 7/2014 | Sato | |
| 2014/0376960 | A1 | 12/2014 | Mushika et al. | |
| 2015/0055974 | A1* | 2/2015 | Hoashi | G03G 21/1842 399/110 |
| 2015/0055975 | A1* | 2/2015 | Sato | G03G 21/1661 399/110 |

FOREIGN PATENT DOCUMENTS

KR 10-2013-0051812 5/2013

OTHER PUBLICATIONS

International Search Report and the Written Opinion of the International Searching Authority dated Feb. 27, 2017 in International Patent Application No. PCT/KR2016/014016.

* cited by examiner

*Primary Examiner* — David M. Gray
*Assistant Examiner* — Andrew V Do
(74) *Attorney, Agent, or Firm* — Staas & Halsey LLP

(57) ABSTRACT

An image forming apparatus includes a tray on which a plurality of developing units are mounted, and a position adjustment unit that is disposed on at least one side of the tray, is movable with respect to the tray, and rotatably supports the plurality of developing units. As the position adjustment unit is moved with respect to the tray, the plurality of developing units are rotated and positions of the plurality of developing units are adjusted by the position adjustment unit.

20 Claims, 19 Drawing Sheets

DEVELOPING UNIT TRANSFERRING DEVICE, IMAGE FORMING APPARATUS EMPLOYING THE DEVELOPING UNIT TRANSFERRING DEVICE, AND DEVELOPING UNIT SEPARATING METHOD OF THE IMAGE FORMING APPARATUS

CROSS-REFERENCE TO RELATED APPLICATIONS

This application claims the priority benefit of Korean Patent Application No. 10-2015-0184008, filed on Dec. 22, 2015, in the Korean Intellectual Property Office, the disclosure of which is incorporated herein in its entirety by reference.

BACKGROUND

1. Field

The following description relates to a developing unit transferring device, an image forming apparatus employing the developing unit transferring device, and a developing unit separating method of the image forming apparatus.

2. Description of the Related Art

Image forming apparatuses, particularly, electrophotographic image forming apparatuses, form an electrostatic latent image on a surface of a photosensitive body by radiating light modulated based on image information onto the photosensitive body, develop the electrostatic latent image into a visible toner image by supplying a toner to the electrostatic latent image, and print an image on a printing medium by transferring and fixing the toner image to the printing medium.

A developing unit is included to form a visible toner image, and may include a toner region that contains toner. A developing unit may be detachably mounted on the body of an image forming apparatus so that the developing unit may be replaced when its lifespan ends or it does not properly operate.

To be detachably mounted on a body of an image forming apparatus, such a developing unit may be mounted directly on the body or may be mounted on the body via a tray, on which the developing unit is mounted.

When a developing unit is mounted using a tray, a plurality of developing units can be attached or detached at one time. Thus, this mounting method is usually used in image forming apparatuses that use a plurality of developing units. However, when a developing unit is mounted using a tray, a movement space for mounting the tray is provided within the body of an image forming apparatus.

SUMMARY

Provided are developing unit separation devices that increase the toner capacity of a developing unit without enlarging an image forming apparatus even when transferring the developing unit by using a tray, and easily replace the developing unit, image forming apparatuses employing the developing unit separation devices, and developing unit separating methods performed by the image forming apparatuses.

Additional aspects will be set forth in part in the description which follows and, in part, will be apparent from the description, or may be learned by practice of the presented embodiments.

According to an aspect of an embodiment, an image forming apparatus includes a body; a plurality of developing units; a tray comprising the plurality of developing units mounted thereon, and movable to a first position at which the tray is inserted into the body and a second position at which the tray is exposed to outside the body; and a position adjustment unit disposed on at least one side of the tray, movable with respect to the tray, and configured to rotatably support the plurality of developing units. As the position adjustment unit is moved with respect to the tray, the plurality of developing units are rotated and positions of the plurality of developing units are adjusted by the position adjustment unit.

When the tray is located at the first position, the plurality of developing units may have first positions where the plurality of developing units partially overlap each other.

Each of the plurality of developing units may include a toner containing unit. When each of the plurality of developing units has the first position, a partial region of the toner containing unit may be disposed over a developing unit adjacent to the each of the plurality of developing units.

When the tray is located at the second position, the plurality of developing units may be rotated by the position adjustment unit, and the plurality of developing units may have second positions where the plurality of developing units do not partially overlap each other.

Each of the plurality of developing units may include a first protrusion provided on a lateral surface that faces the position adjustment unit and positioned at a location that is off from a center of gravity of each of the plurality of developing units. The position adjustment unit may include a support area that contacts and supports the first protrusion.

Each of the plurality of developing units may include a second protrusion provided on the lateral surface that faces the position adjustment unit and positioned at a location away from the first protrusion. The position adjustment unit may include a rotating angle restricting area that restricts a rotating angle of the second protrusion.

One of the tray and the position adjustment unit may include a guide hole that extends at an angle to a movement direction of the tray, and the other of the tray and the position adjustment unit may include a guide protrusion that is insertable into the guide hole.

The body may further include an interfering member that protrudes toward the tray.

The tray may include a rotating member that is pressed and rotated by the interfering member while the tray is moving from the first position to the second position, and the position adjustment unit may be moved with respect to the tray in connection with the rotating member.

The image forming apparatus may further include an elastic member that restores the position adjustment unit to its original location, when the pressing of the rotating member by the interfering member is released.

The position adjustment unit may further include an inclined rail that extends at an angle to a movement direction of the tray and into which the interfering member is insertable.

The image forming apparatus may further include a handle unit rotatably provided on the tray, and the position adjustment unit may be moved with respect to the tray in connection with a rotation of the handle unit.

According to an aspect of an embodiment, a developing unit transferring device of an image forming apparatus includes a plurality of developing units; a tray comprising the plurality of developing units mounted thereon, and movable to a first position at which the tray is inserted into a body of the image forming apparatus and a second position at which the tray is exposed to outside the body; and a position adjustment unit disposed on at least one side of the tray, movable with respect to the tray, and configured to rotatably support the plurality of developing units. As the position adjustment unit is moved with respect to the tray, the plurality of developing units are rotated and positions of the plurality of developing units are adjusted by the position adjustment unit.

When the tray is located at the first position, the plurality of developing units may have first positions where the plurality of developing units partially overlap each other.

When the tray is located at the second position, the plurality of developing units may be rotated by the position adjustment unit, and the plurality of developing units may have second positions where the plurality of developing units do not partially overlap each other.

Each of the plurality of developing units may include a first protrusion provided on a lateral surface that faces the position adjustment unit and positioned at a location that is off from a center of gravity of each of the plurality of developing units. The position adjustment unit may include a support area that contacts and supports the first protrusion.

Each of the plurality of developing units may include a second protrusion provided on the lateral surface that faces the position adjustment unit and positioned at a location away from the first protrusion. The position adjustment unit may include a rotating angle restricting area that restricts a rotating angle of the second protrusion.

According to an aspect of an embodiment, a developing unit separating method of an image forming apparatus includes withdrawing a tray including a plurality of developing units mounted thereon, from a body of the image forming apparatus; moving a position adjustment unit that is disposed on at least one side of the tray and rotatably supports the plurality of developing units, with respect to the tray; adjusting positions of the plurality of developing units by rotating the plurality of developing units, due to a movement of the position adjustment unit; and separating at least one of the position-adjusted developing units from the tray.

Before the adjusting of the positions of the plurality of developing units, the plurality of developing units mounted on the tray may partially overlap each other.

In the adjusting of the positions of the plurality of developing units, the plurality of developing units may be rotated such that the plurality of developing units do not overlap each other.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
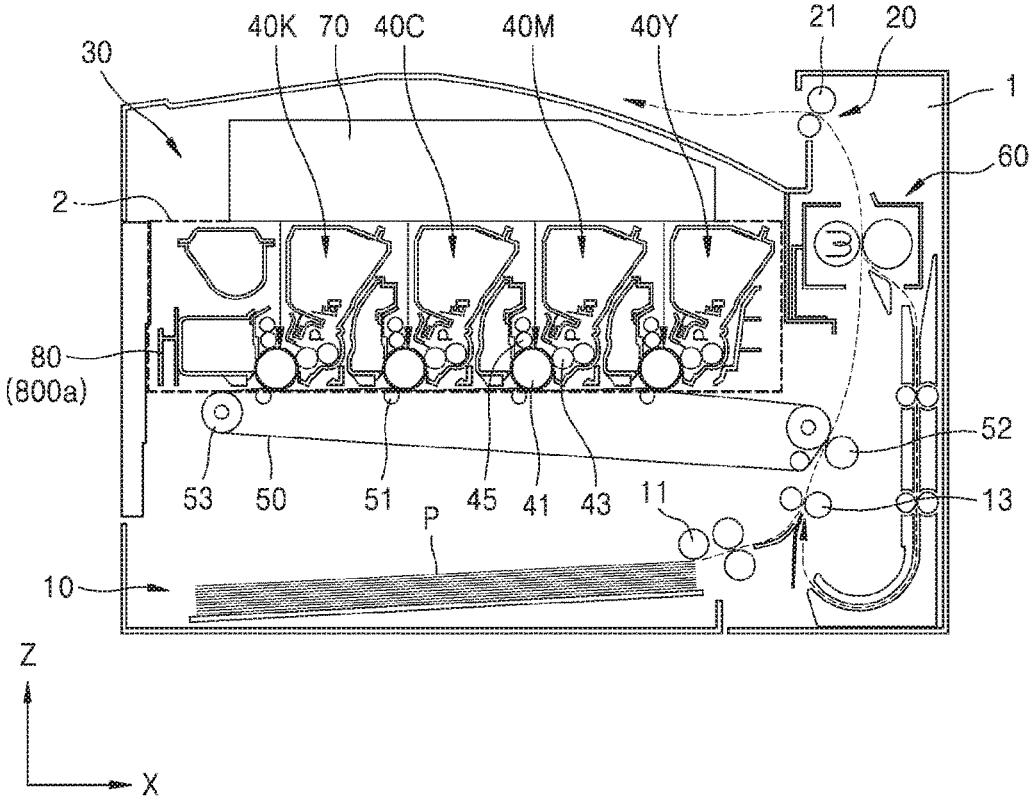
FIG. 1 is a conceptual diagram of an image forming apparatus according to an embodiment.

Hereinafter, features and effects of the disclosure will be described more fully with reference to the accompanying drawings, in which exemplary embodiments of the disclosure are shown.

Terms used herein will be described briefly, and the present disclosure will be described in detail.

Although general terms widely used at present were selected for describing the present disclosure in consideration of the functions thereof, these general terms may vary according to intentions of one of ordinary skill in the art, case precedents, the advent of new technologies, or the like. Terms arbitrarily selected by the applicant of the present disclosure may also be used in a specific case. In this case, their meanings need to be given in the detailed description of the disclosure. Hence, the terms must be defined based on their meanings and the contents of the entire specification, not by simply stating the terms.

The terms "comprises" and/or "comprising" or "includes" and/or "including" when used in this specification, specify the presence of stated elements, but do not preclude the presence or addition of one or more other elements.

It will be understood that although the terms "first," "second," etc. may be used herein to describe various components, these components should not be limited by these terms. These components are only used to distinguish one component from another.

The present disclosure will now be described more fully with reference to the accompanying drawings, in which exemplary embodiments of the disclosure are shown. The disclosure may, however, be embodied in many different forms and should not be construed as being limited to the embodiments set forth herein. In the drawings, parts irrelevant to the description are omitted for the simplicity of explanation, and like numbers refer to like elements throughout.

Figure 2:
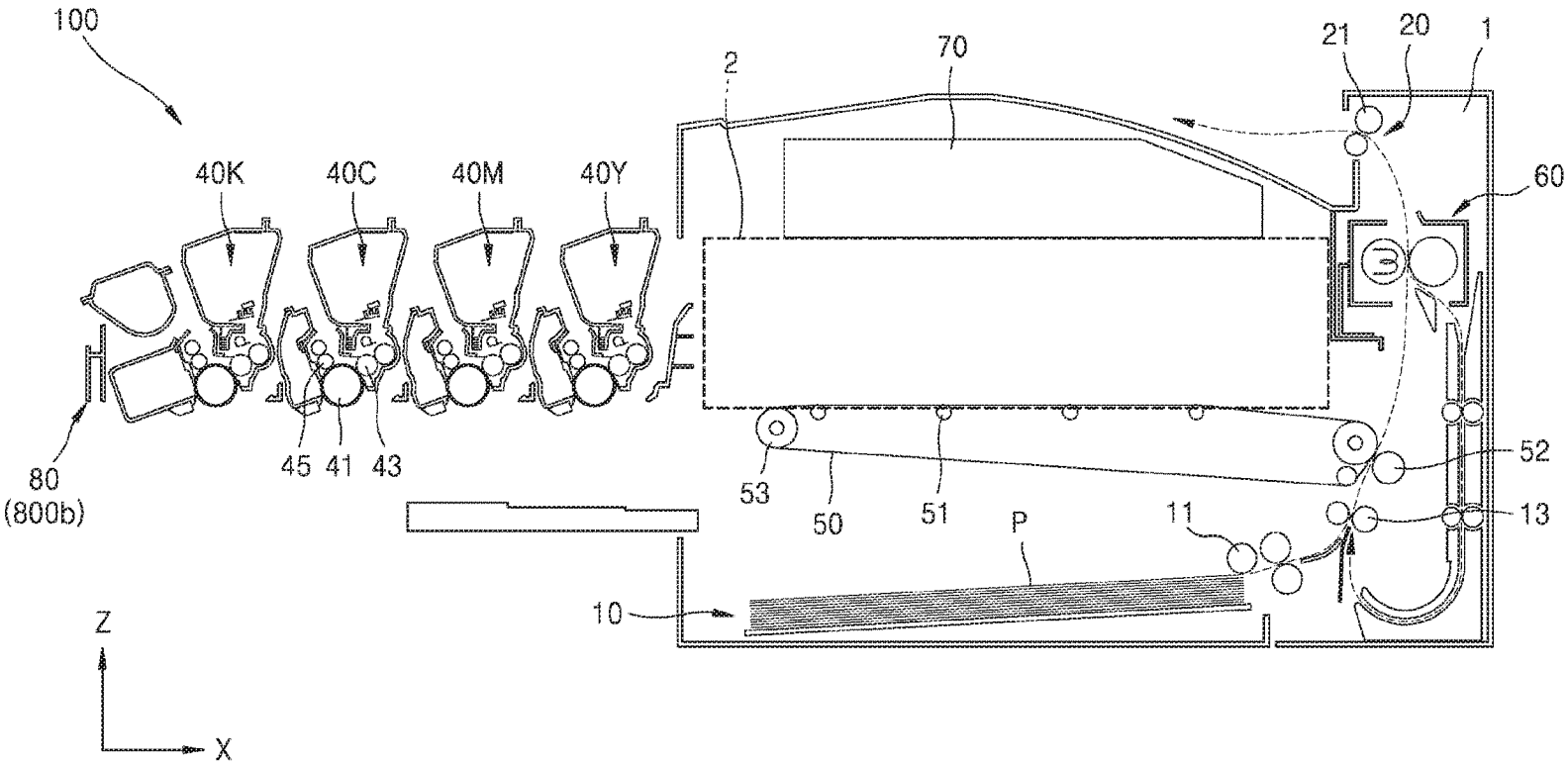
FIG. 2 illustrates a tray withdrawn from a body of the image forming apparatus of FIG. 1.

FIG. 1 is a conceptual diagram of an image forming apparatus according to an embodiment. FIG. 2 illustrates a tray 80 withdrawn from a body 1 of the image forming apparatus of FIG. 1.

Referring to FIG. 1, the image forming apparatus according to an embodiment may include a paper supply device 10, a paper feeding device 20, and a printing device 30.

A printing medium P, on which an image is to be formed, is loaded on the paper supply device 10, and the printing medium P is picked up by a pickup roller 11 sheet-by-sheet. The picked-up recording medium P is transferred toward the printing device 30 by a transfer roller 13.

A printing medium P, on which printing has been completed by the printing device 30, is discharged by a discharging roller 21 and loaded on the paper feeding device 20.

The printing device 30 forms an image on the printing medium P, and may include developing units 40Y, 40M, 40C, and 40K, an intermediate transfer belt 50, an intermediate transfer roller 51, a final transfer roller 52, an exposing unit 70, and a fixing unit 60.

The exposing unit 70 radiates light modulated in correspondence with image information onto photoconductive drums 41 and forms electrostatic latent images on the photoconductive drums 41. The exposing unit 70 may be implemented using a light-emitting diode (LED) type exposing unit 70 that allows a plurality of LEDs arranged in a main scanning direction to selectively emit light according to image information. Alternatively, the exposing unit 70 may be implemented using a laser scanning unit (LSU) that deflects light emitted from a laser diode in the main scanning direction by using a light deflector and scans the photoconductive drums 41 with deflected light.

The developing units 40Y, 40M, 40C, and 40K form a toner image by attaching toner accommodated within the developing units 40Y, 40M, 40C, and 40K onto the electrostatic latent images formed on the photoconductive drums 41. Each of the developing units 40Y, 40M, 40C, and 40K may include a developing roller 43 supplying the toner accommodated within each of the developing units 40Y, 40M, 40C, and 40K onto the electrostatic latent image formed on each of the photoconductive drums 41, and a charging roller 45 charging a surface of each of the photoconductive drums 41 with uniform potential. A plurality of developing units 40Y, 40M, 40C, and 40K may be included. For example, the image forming apparatus may include the four developing units 40Y, 40M, 40C, and 40K in order to perform color printing.

A developing bias voltage for supplying toner onto an electrostatic latent image is applied to the developing roller 43, and a charging bias voltage is applied to the charging roller 45. A corona charger may be used instead of the charging roller 45. The photoconductive drum 41 is an example of a photoconductor on which an electrostatic latent image is formed. The photoconductive drum 41 may be obtained by forming a photoconductive layer on an outer circumference of a cylindrical metal pipe.

The intermediate transfer belt 50 is an intermediate medium where a toner image is temporarily transferred before a toner image is finally transferred onto the printing medium P, and is circulated by being supported by support rollers 53.

The intermediate transfer roller 51 is an example of an intermediate transfer member for transferring the toner image formed on a photoconductive drum 41 to the intermediate transfer belt 50. Four intermediate transfer rollers 51 respectively face four photoconductive drums 41 with the intermediate transfer belt 50 therebetween. An intermediate transfer bias voltage for transferring the toner image formed on the photoconductive drum 41 to the intermediate transfer belt 50 is applied to the intermediate transfer roller 51.

The final transfer roller 52 is an example of a final transferrer for transferring the toner image on the intermediate transfer belt 50 to the printing medium P. A final transfer bias voltage for transferring the toner image on the intermediate transfer belt 50 to the printing medium P may be applied to the final transfer roller 52. A corona transferrer may be used instead of the final transfer roller 52. The fixing unit 60 fixes the toner image transferred onto the printing medium P by applying heat and pressure to the toner image.

Referring to FIGS. 1 and 2, the image forming apparatus may include the tray 80 on which the plurality of developing units 40Y, 40M, 40C, and 40K are mountable, in order to mount the plurality of developing units 40Y, 40M, 40C, and 40K on the body 1 or separate the same from the body 1.

The tray 80 is slidable with respect to the body 1. The tray 80 is movable to a first position 800*a* where the entire tray 80 is inserted into the body 1, and a second position 800*b* where at least a portion of the tray 80 is exposed to the outside of the body 1. When the tray 80 is located at the second position 800*b*, the plurality of developing units 40Y, 40M, 40C, and 40K mounted on the tray 80 may be exposed to the outside of the body 1.

A user moves the tray 80 forwards and thus inserts the plurality of developing units 40Y, 40M, 40C, and 40K mounted on the tray 80 into the body 1. The user moves the tray 80 backwards and thus withdraws the plurality of developing units 40Y, 40M, 40C, and 40K mounted on the tray 80 from the body 1. Forwards used herein is defined as a +X direction, and backwards used herein is defined as a −X direction, which is a direction reverse to forwards.

In order to move the tray 80 to the first position 800*a* and the second position 800*b*, the body 1 includes a movement space 2 allowing the tray 80 and the developing units 40Y, 40M, 40C, and 40K mounted on the tray 80 to move without bumping into the body 1.

The image forming apparatus according to an embodiment includes a developing unit transferring device 100 having a structure capable of increasing toner containing capacities of the developing units 40Y, 40M, 40C, and 40K without increasing the size of the movement space 2 in a vertical direction.

Figure 3:
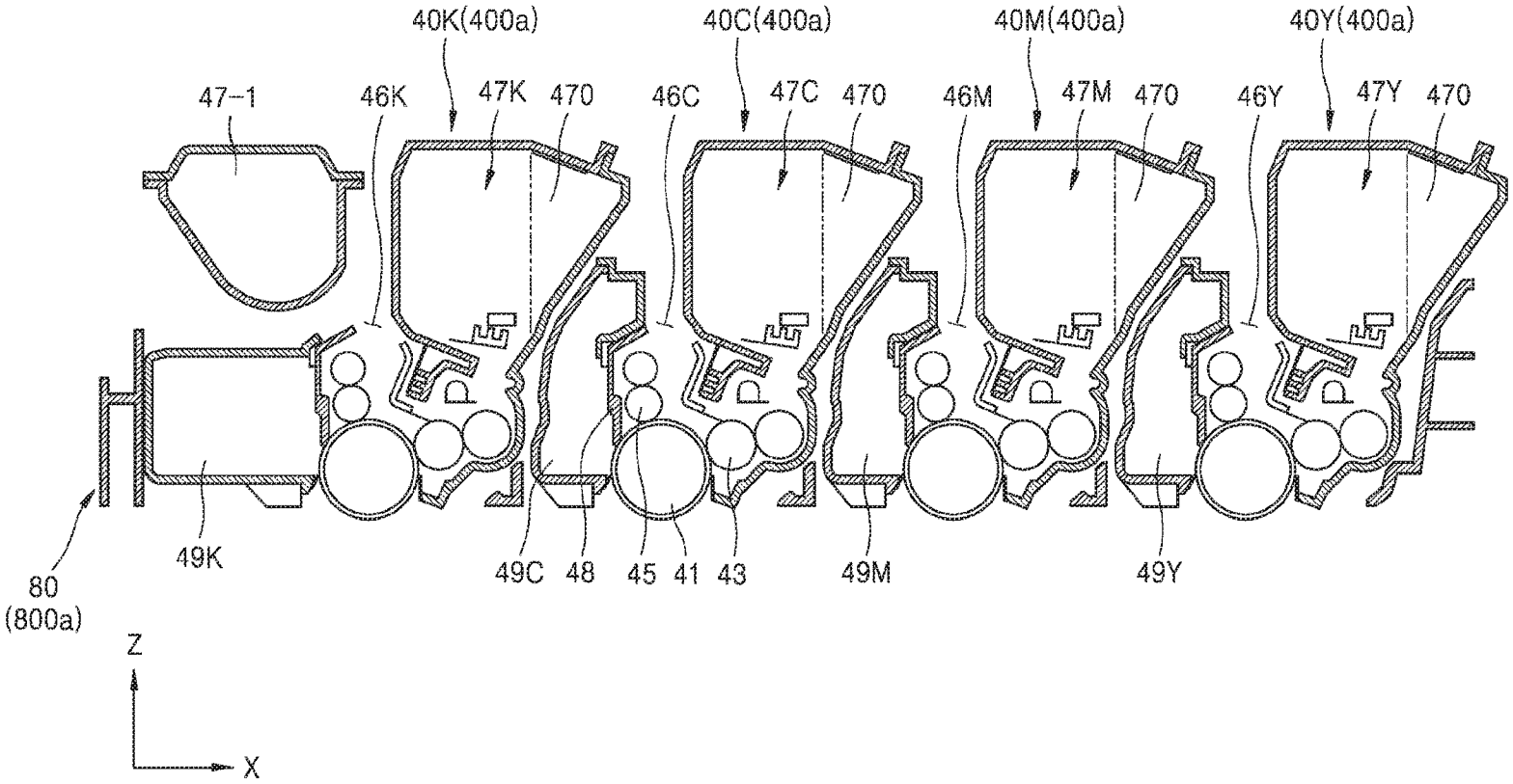
FIG. 3 illustrates a plurality of the developing units mounted on the tray in the image forming apparatus of FIG. 1.

FIG. 3 illustrates the plurality of developing units 40Y, 40M, 40C, and 40K mounted on the tray 80 in the image forming apparatus of FIG. 1. Each of the plurality of developing units 40Y, 40M, 40C, and 40K takes a first position.

Referring to FIG. 3, the plurality of developing units 40Y, 40M, 40C, and 40K respectively include toner containing units 47Y, 47M, 47C, and 47K, which supply toner. Each of the developing units 40Y, 40M, 40C, and 40K according to an embodiment may be obtained by integrating a toner cartridge including each of the toner containing units 47Y, 47M, 47C, and 47K with a photoconductor cartridge including the photoconductive drum 41 and a development cartridge including the developing roller 43.

The structure of each of the developing units 40Y, 40M, 40C, and 40K is not limited thereto. For example, each of the developing units 40Y, 40M, 40C, and 40K may be a first structure divided into the toner cartridge including each of the toner containing units 47Y, 47M, 47C, and 47K and an imaging unit including the photoconductive drum 41 and the developing roller 43, or a second structure divided into the photoconductor cartridge, the development cartridge, and the toner cartridge, or a third structure divided into the photoconductor cartridge and the development cartridge.

The plurality of developing units 40Y, 40M, 40C, and 40K may respectively include cleaning members 48 for removing residual toner from the photoconductive drums 41, and waste toner containing units 49Y, 49M, 49C, and 49K for containing the removed toner. According to an embodiment, although not shown in the drawings, a waste toner transfer member (not shown) may be disposed instead of the waste toner containing units 49Y, 49M, 49C, and 49K.

The developing unit 40K containing black toner may have a different shape than those of the other developing units 40Y, 40M, and 40C. For example, the waste toner containing unit 49K of the developing unit 40K, which contains black toner, may be larger than the waste toner containing units 49Y, 49M, and 49C of the other developing units 40Y, 40M, and 40C, and the developing unit 40K, which contains black toner, may further include an additional toner containing unit 47-1. Accordingly, the developing unit 40K, which is more frequently used than the other developing units 40Y, 40M, and 40C, may have an increased toner capacity and an increased waste toner capacity. However, the shape of the developing unit 40K containing black toner is not limited thereto, and the developing unit 40K may have the same shape as the other developing units 40Y, 40M, and 40C.

Exposure holes 46Y, 46M, 46C, and 46K, through which light radiated by the exposing unit 70 (see FIG. 1) may pass, are formed between the toner containing units 47Y, 47M, 47C, and 47K and the waste toner containing units 49Y, 49M, 49C, and 49K, respectively. In the developing units 40Y, 40M, 40C, and 40K, the toner containing units 47Y, 47M, 47C, and 47K are respectively in a front direction (+X direction) of the exposure holes 46Y, 46M, 46C, and 46K, and the waste toner containing units 49Y, 49M, 49C, and 49K are respectively in a rear direction (−X direction) of the exposure holes 46Y, 46M, 46C, and 46K.

The toner containing units 47Y, 47M, 47C, and 47K of the developing units 40Y, 40M, 40C, and 40K according to an embodiment may include extended regions 470, respectively, extending in the front direction (+X direction). The developing units 40Y, 40M, 40C, and 40K may additionally contain an amount of toner corresponding to the extended regions 470.

When the tray 80 is at the first position 800*a*, each of the plurality of developing units 40Y, 40M, 40C, and 40K may have a first position 400*a*. When each of the plurality of developing units 40Y, 40M, 40C, and 40K has the first position 400*a*, the respective extended regions 470 of the plurality of developing units 40Y, 40M, 40C, and 40K may respectively overlap their adjacent developing units 40Y, 40M, 40C, and 40K. For example, the extended region 470 of the developing unit 40C overlaps the waste toner containing unit 49M of the developing unit 40M adjacent to the developing unit 40C.

If the extended regions 470 of the toner containing units 47Y, 47M, 47C, and 47K extend not in the front direction (+X direction) but in an upper direction (+Z direction), the extension of the extended regions 470 in the upper direction (+Z direction) may be similar to the extension in the front direction (+X direction) in terms of an increase in the toner capacities of the developing units 40Y, 40M, 40C, and 40K, but the movement space 2 for moving the tray 80 including the developing units 40Y, 40M, 40C, and 40K mounted thereon increases in the upper direction (+Z direction), by as much as the extensions of the developing units 40Y, 40M, 40C, and 40K in the upper direction (+Z direction). Accordingly, the size of the movement space 2 in a vertical direction (Z direction) of the image forming apparatus increases.

However, in the image forming apparatus according to an embodiment, because the extended regions 470 of the developing units 40Y, 40M, 40C, and 40K extend in the front direction (+X direction) and overlap their adjacent developing units 40Y, 40M, 40C, and 40K, the toner capacities of the developing units 40Y, 40M, 40C, and 40K may be increased without increasing the size of the movement space 2 of the tray 80 in the vertical direction (Z direction).

In addition, because the extended regions 470 of the developing units 40Y, 40M, 40C, and 40K extend not in the rear direction (−X direction) but in the front direction (+X direction), the toner capacities of the developing units 40Y, 40M, 40C, and 40K may be increased without blocking the exposure holes 46Y, 46M, 46C, and 46K of the developing units 40Y, 40M, 40C, and 40K.

Figure 4A:
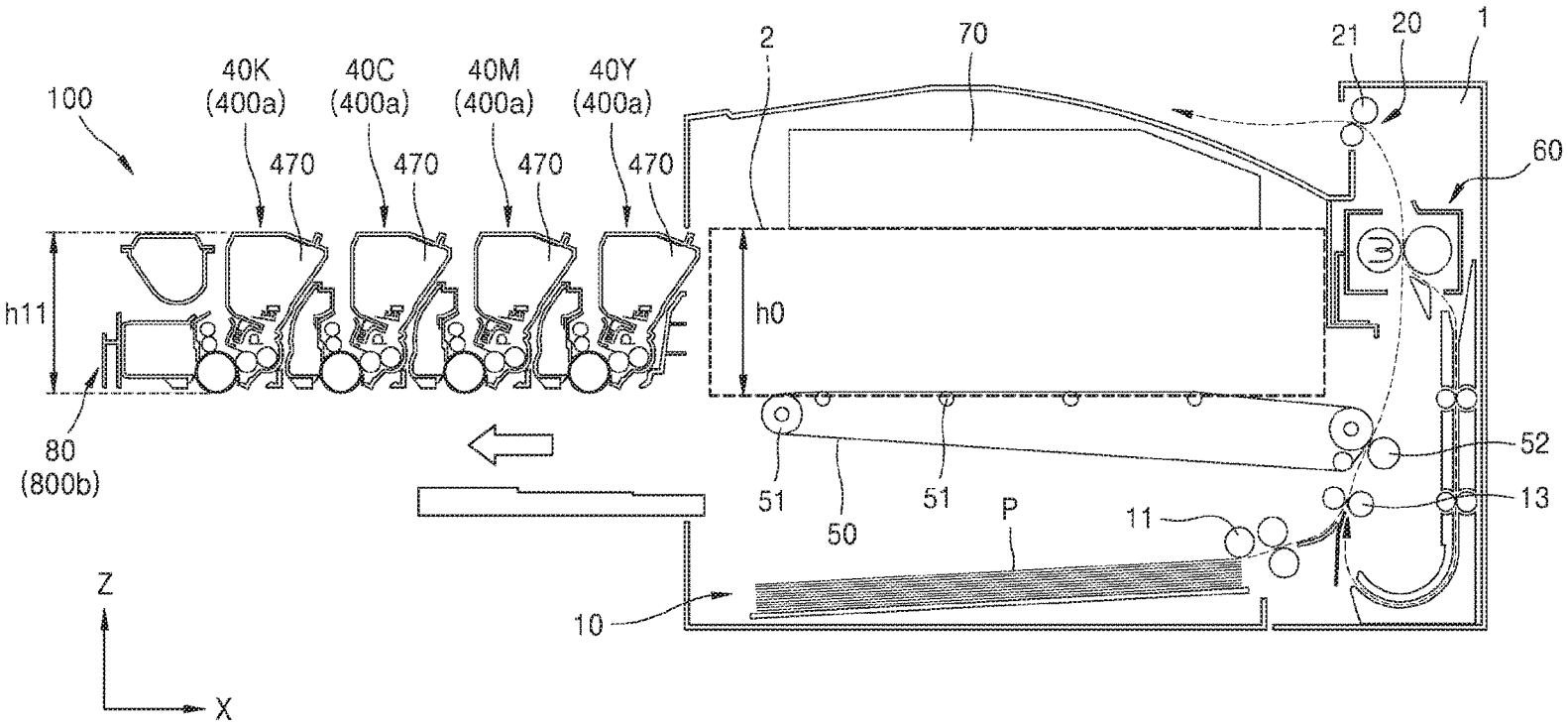
FIGS. 4A, 4B, and 4C illustrate separation or replacement of the developing units in a developing unit transferring device of an image forming apparatus according to an embodiment.
Figure 4B:
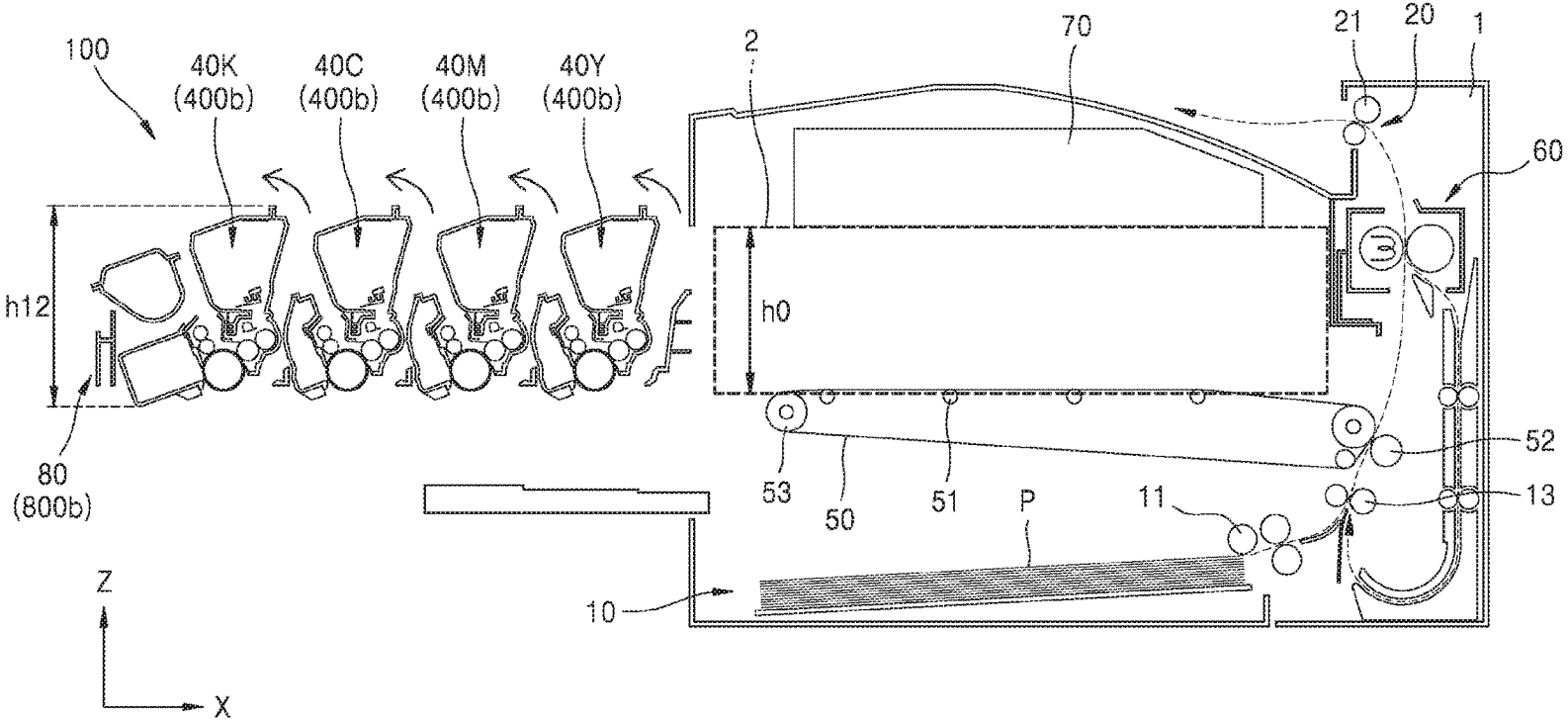
Figure 4C:
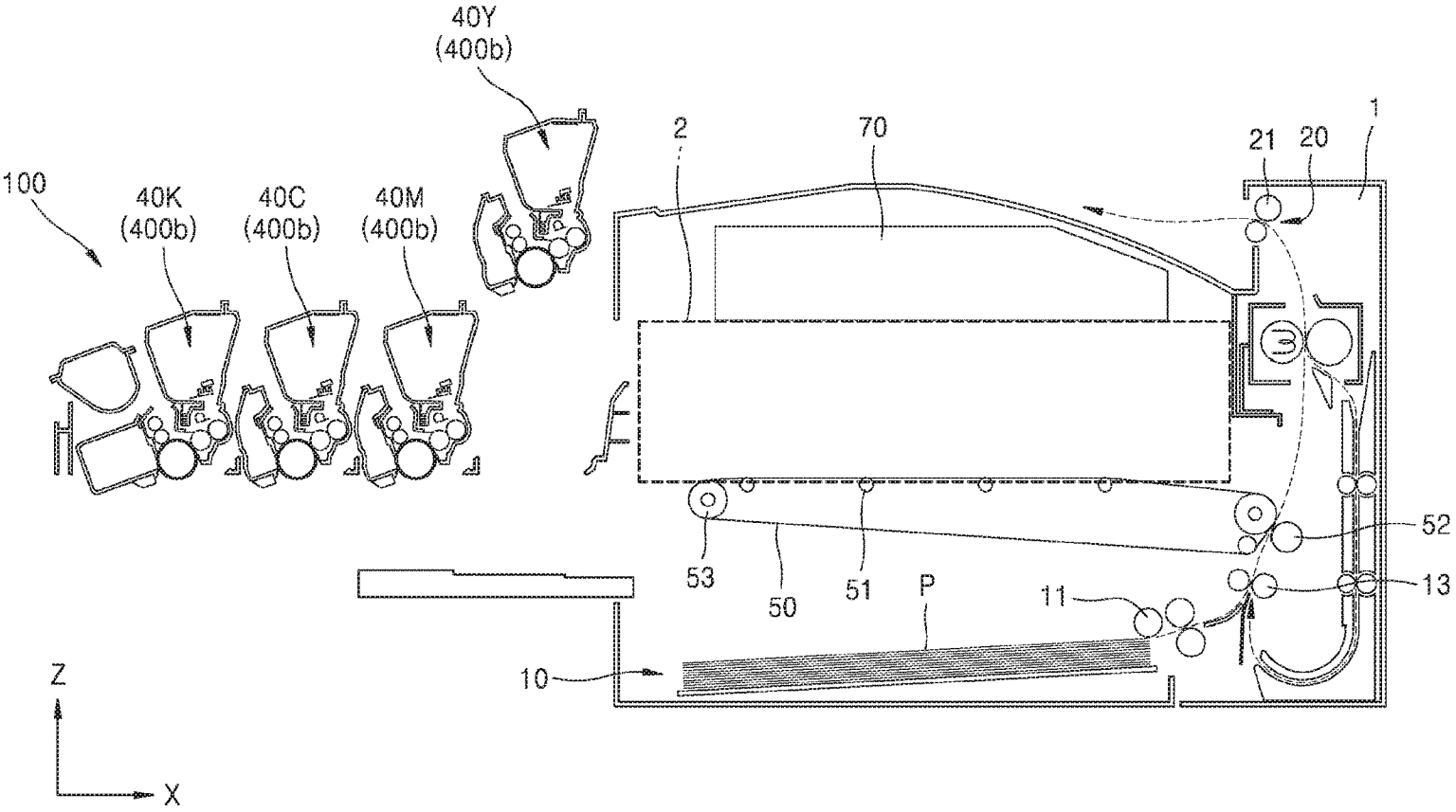

FIGS. 4A-4C illustrate separation or replacement of the developing units 40Y, 40M, 40C, and 40K in the developing unit transferring device 100 of the image forming apparatus of FIG. 1. FIGS. 4A-4C illustrate separation of the developing unit 40Y among the plurality of developing units 40Y, 40M, 40C, and 40K within the image forming apparatus of FIG. 1.

Referring to FIG. 4A, the tray 80 is withdrawn in the rear direction (−X direction) and is moved outside the body 1. The tray 80 is moved from the first position 800*a* (see FIG. 1) to a second position 800*b*. Accordingly, the plurality of developing units 40Y, 40M, 40C, and 40K mounted on the tray 80 are exposed to the outside of the body 1. Each of the plurality of developing units 40Y, 40M, 40C, and 40K has the first position 400*a*, and every two adjacent developing units of the developing units 40Y, 40M, 40C, and 40K partially overlap each other. As for the two adjacent developing units 40Y and 40M, the extended region 470 of the developing unit 40M, located at the rear, overlaps the developing unit 40Y, located in front, in the vertical direction (Z direction). A height h11 of each of the developing units 40Y, 40M, 40C, and 40K having the first positions 400*a* is less than a height h0 of the movement space 2 within the body 1.

Referring to FIG. 4B, positions of the plurality of developing units 40Y, 40M, 40C, and 40K mounted on the tray 80 are adjusted from the first positions 400*a* to the second positions 400*b*. For example, the positions of the plurality of developing units 40Y, 40M, 40C, and 40K are adjusted or changed so that every two adjacent developing units of the developing units 40Y, 40M, 40C, and 40K do not overlap each other. A height h12 of each of the developing units 40Y, 40M, 40C, and 40K having the second positions 400*b* is greater than the height h11 (see FIG. 4A) of each of the developing units 40Y, 40M, 40C, and 40K having the first positions 400*a*.

The height h0 of the movement space 2 within the body 1 may be less than the height h12 of each of the developing units 40Y, 40M, 40C, and 40K having the second positions 400*b*. Accordingly, without increasing the size of the image forming apparatus in the vertical direction (Z direction), the developing units 40Y, 40M, 40C, and 40K included in the image forming apparatus may have increased toner capacities.

Referring to FIG. 4C, the plurality of developing units 40Y, 40M, 40C, and 40K in the second positions 400*b* do not overlap each other in the vertical direction (Z direction). Accordingly, a user is able to vertically separate the developing units 40Y, 40M, 40C, and 40K from the tray 80. The user is also able to vertically mount the developing units 40Y, 40M, 40C, and 40K onto the tray 80.

If a process of adjusting the positions of the developing units 40Y, 40M, 40C, and 40K to the second positions 400*b* as shown in FIG. 4B is not performed, every two adjacent developing units of the developing units 40Y, 40M, 40C, and 40K overlap each other in the vertical direction (Z direction). In other words, as shown in FIG. 4A, the extended regions 470 of the developing units 40Y, 40M, 40C, and 40K, which are located at the rear, overlap the developing units 40Y, 40M, 40C, and 40K, which are located in front. Thus, when the developing units 40Y, 40M, 40C, and 40K, which are located in front, need to be separated, all of the developing units 40Y, 40M, 40C, and 40K, which are located at the rear, also should be separated. In particular, when the foremost developing unit 40Y needs to be separated, all of the other developing units 40M, 40C, and 40K also need to be separated. In addition, in order to separate the foremost developing unit 40Y without adjusting the positions of the developing units 40Y, 40M, 40C, and 40K, the extended region 470 of the foremost developing unit 40Y needs to be exposed to the outside of the body 1. To this end, the length of the tray 80 or a member for guiding movement of the tray 80 may be increased by the length of the extended region 470. This may cause an increase in the length of the body 1 in a forward-backward direction (X direction).

However, in the developing unit transferring device 100 according to an embodiment, while or at the moment when the tray 80 is being located at the second position 800*b*, the positions of the plurality of developing units 40Y, 40M, 40C, and 40K mounted on the tray 80 may be adjusted such that the plurality of developing units 40Y, 40M, 40C, and 40K do not overlap each other, and thus only desired developing units 40Y, 40M, 40C, and 40K may be separated from the tray 80. In addition, by adjusting the positions of the developing units 40Y, 40M, 40C, and 40K such that the extended region 470 of the foremost developing unit 40Y is exposed to the outside, only desired developing units 40Y, 40M, 40C, and 40K may be separated without increasing the length of the image forming apparatus by the length of the extended region 470.

A structure for adjusting the positions (or angles) of the plurality of developing units 40Y, 40M, 40C, and 40K mounted on the tray 80 will now be described.

Figure 5:
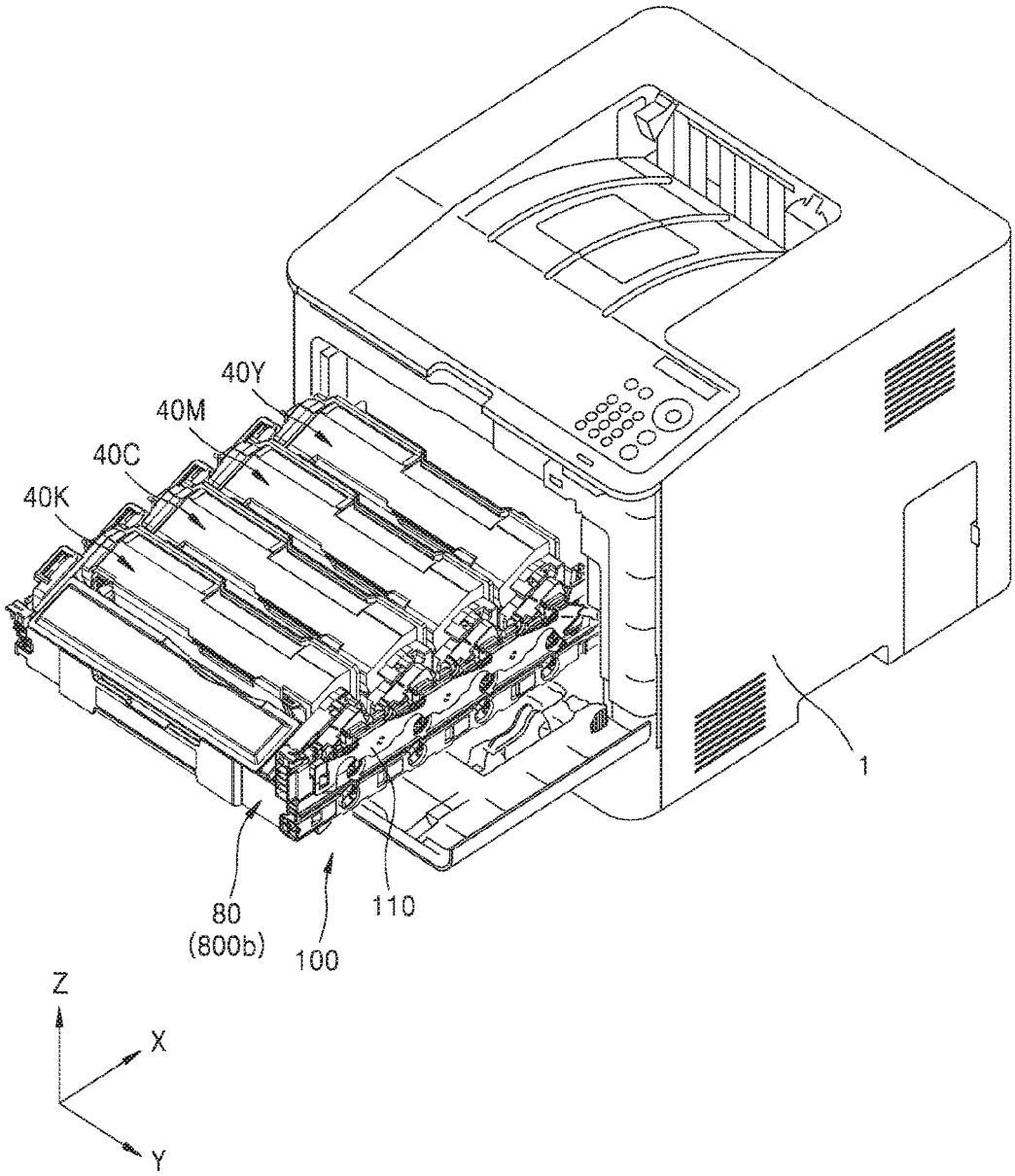
FIG. 5 illustrates an example of the developing unit transferring device of the image forming apparatus according to an embodiment.
Figure 6A:
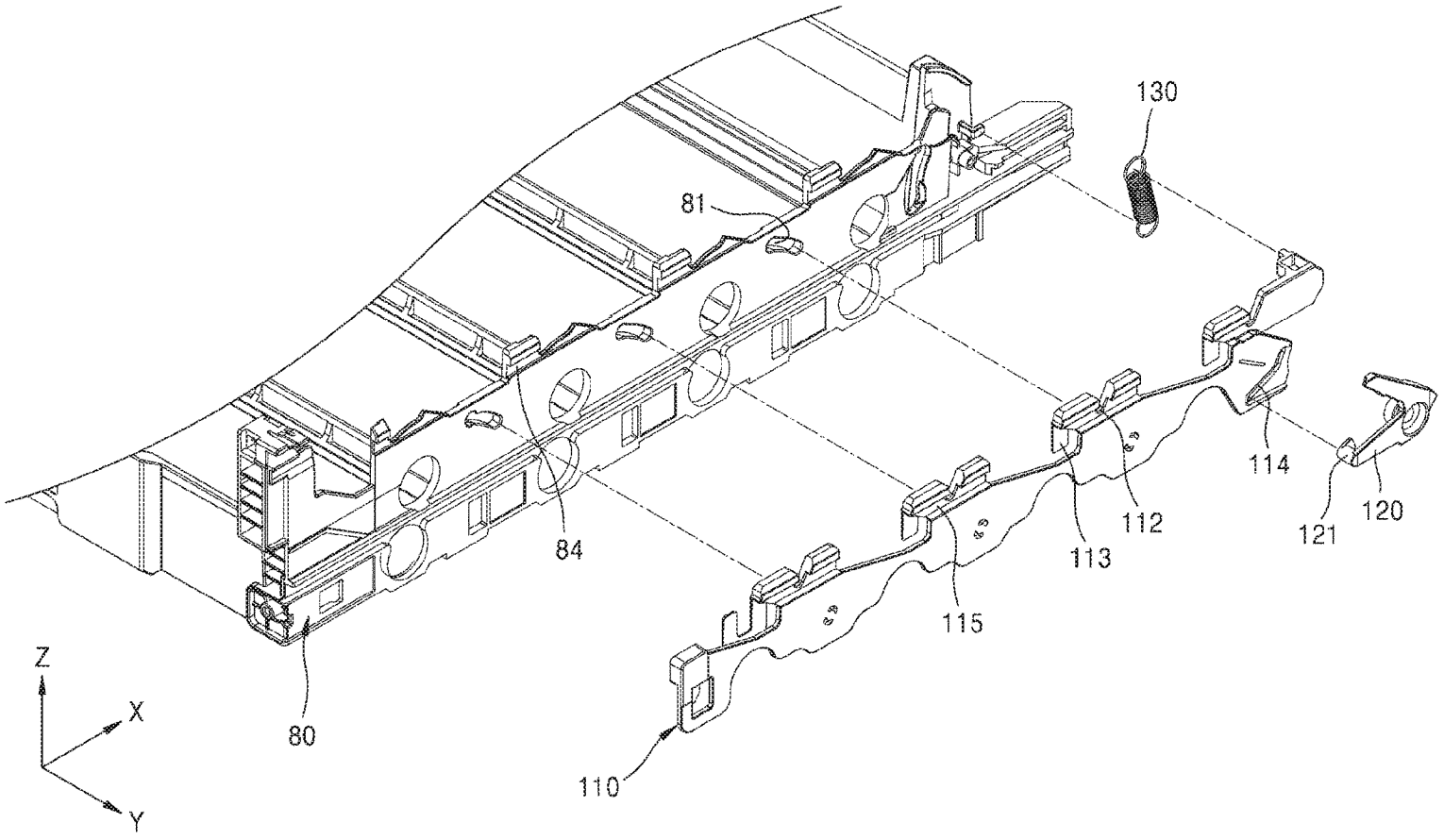
FIGS. 6A and 6B illustrate the tray and a position adjustment unit of the developing unit transferring device according to an embodiment.
Figure 6B:
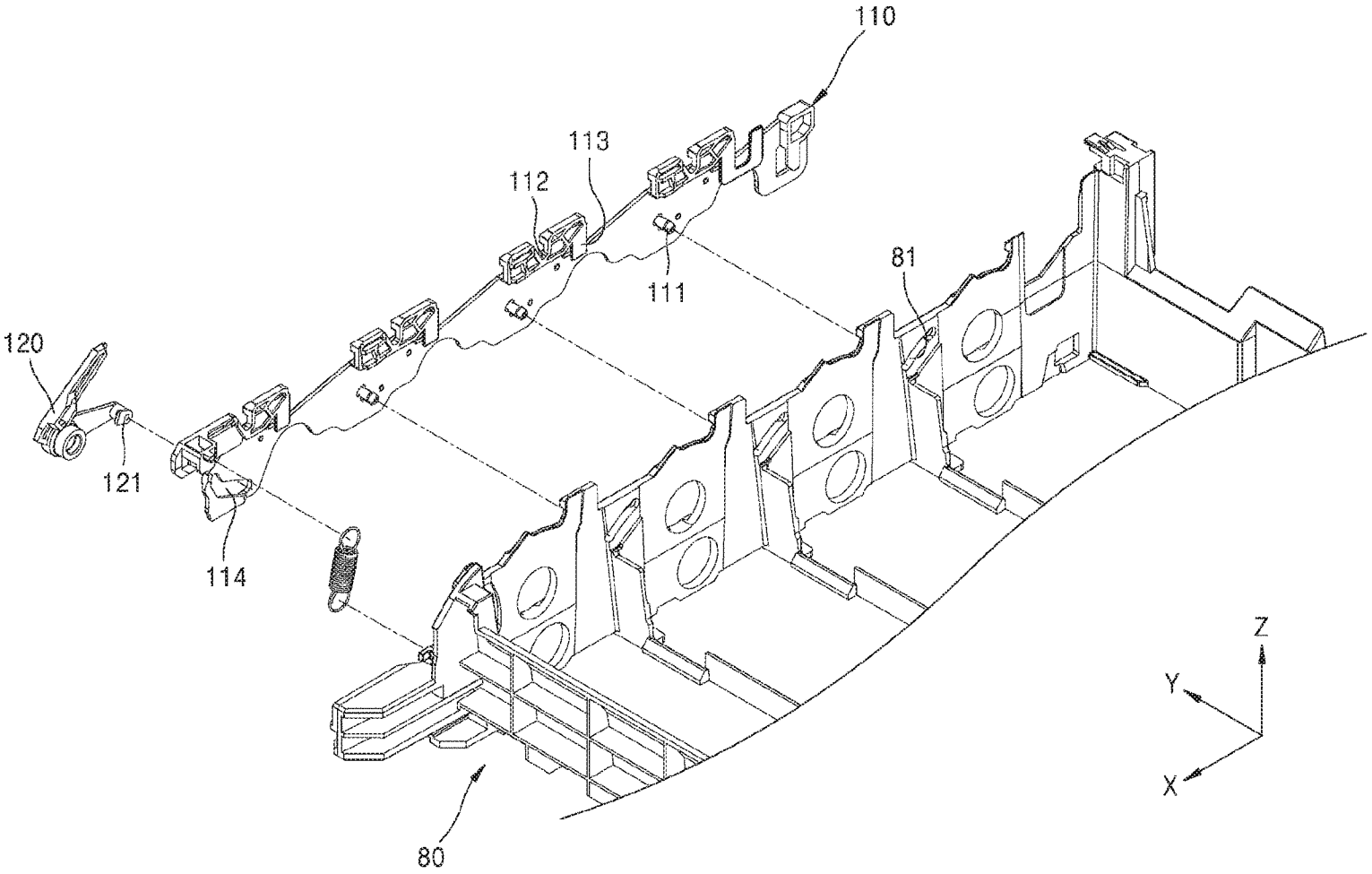

FIG. 5 illustrates an example of the developing unit transferring device 100 of the image forming apparatus according to an embodiment. FIGS. 6A and 6B illustrate the tray 80 and a position adjustment unit 110 of the developing unit transferring device 100 according to an embodiment.

Referring to FIGS. 5, 6A, and 6B, the position adjustment unit 110 may be disposed on at least one side of the tray 80. For example, the position adjustment unit 110 may be disposed on one side of the tray 80 in a Y direction.

The position adjustment unit 110 is movably provided on the tray 80. For example, the tray 80 includes guide holes 81 inclined with respect to a movement direction of the tray 80, for example, an X direction. The position adjustment unit 110 includes guide protrusions 111 that are insertable into the guide holes 81, respectively.

When the guide protrusions 111 are respectively inserted into the guide holes 81 and an external force is applied to the tray 80 or the position adjustment unit 110, the guide protrusions 111 move along the guide holes 81. Accordingly, the position adjustment unit 110 including the guide protrusions 111 moves with respect to the tray 80 including the guide holes 81.

The guide holes 81 may extend at an inclination with respect to a forward-backward direction (X direction). For example, the extending direction of the guide holes 81 may make an acute angle with a rear direction (−X direction).

The guide protrusions 111 moving along the guide holes 81, and the position adjustment unit 110 including the guide protrusions 111 may ascend with respect to the tray 80. For example, the position adjustment unit 110 may ascend while moving with respect to the tray 80 in the rear direction (−X direction) along the shape of the guide holes 81.

Although the guide protrusions 111 are formed on the position adjustment unit 110 and the guide holes 81 are formed in the tray 80 according to the present embodiment, the locations of the guide protrusions 111 and the guide holes 81 are not limited thereto, and may vary. For example, the guide protrusions 111 may be formed on the tray 80, and the guide holes 81 may be formed in the position adjustment unit 110. Although three guide protrusions 111 and three guide holes 81 are illustrated in the present embodiment, embodiments are not limited thereto, and the number of guide protrusions 111 and the number of guide holes 81 may each be at most two or at least four.

The position adjustment unit 110 provided on the tray 80 may contact and support the plurality of developing units 40Y, 40M, 40C, and 40K. For example, the position adjustment unit 110 may rotatably support the plurality of developing units 40Y, 40M, 40C, and 40K.

Figure 7:
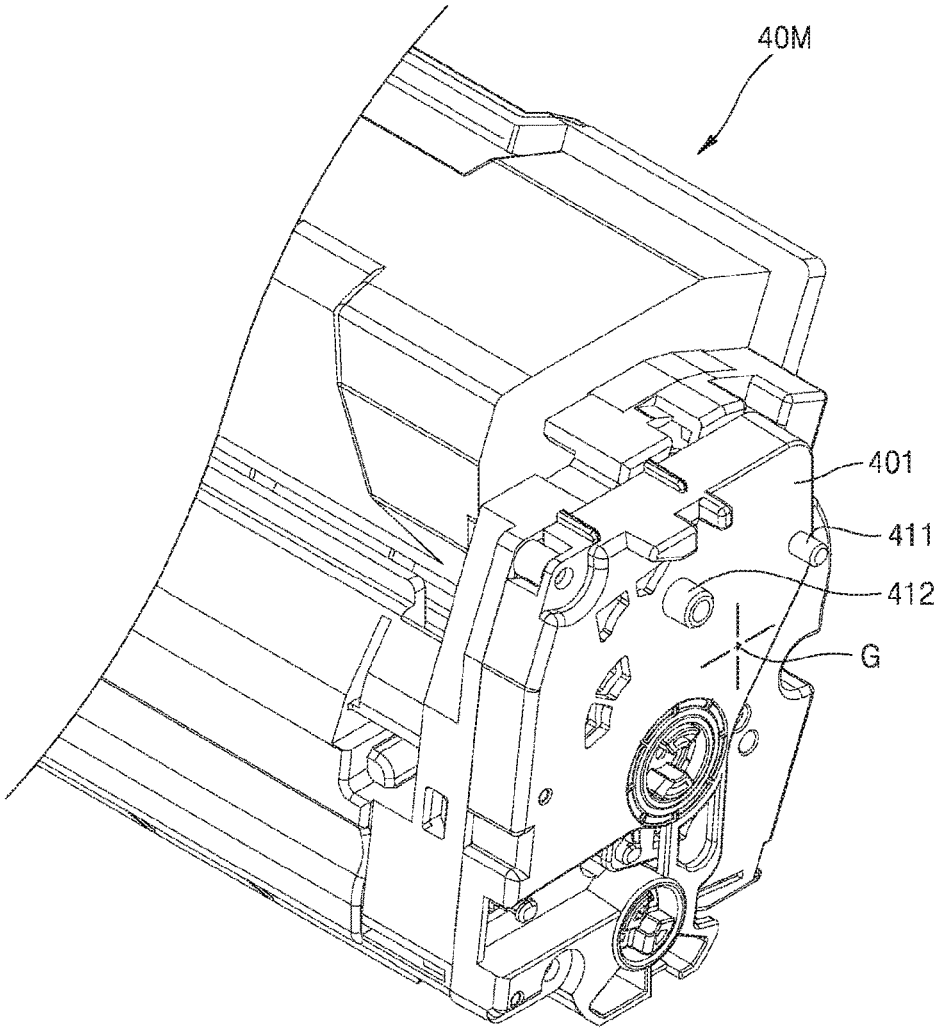
FIG. 7 illustrates a developing unit according to an embodiment.

FIG. 7 is a perspective view of the developing unit 40M according to an embodiment.

Referring to FIG. 7, the developing unit 40M includes a first protrusion 411 and a second protrusion 412. The first protrusion 411 and the second protrusion 412 may be arranged on a lateral surface 401 of the developing unit 40M that faces the position adjustment unit 110. The first protrusion 411 is at a location that is offset from the center of gravity G of the developing unit 40M. The second protrusion 412 is at a location that is offset from the center of gravity G of the developing unit 40M.

Although FIG. 7 illustrates the developing unit 40M, each of the other developing units 40Y, 40C, and 40K may have a similar structure to the developing unit 40M, and a repeated description thereof will be omitted here.

Figure 8:
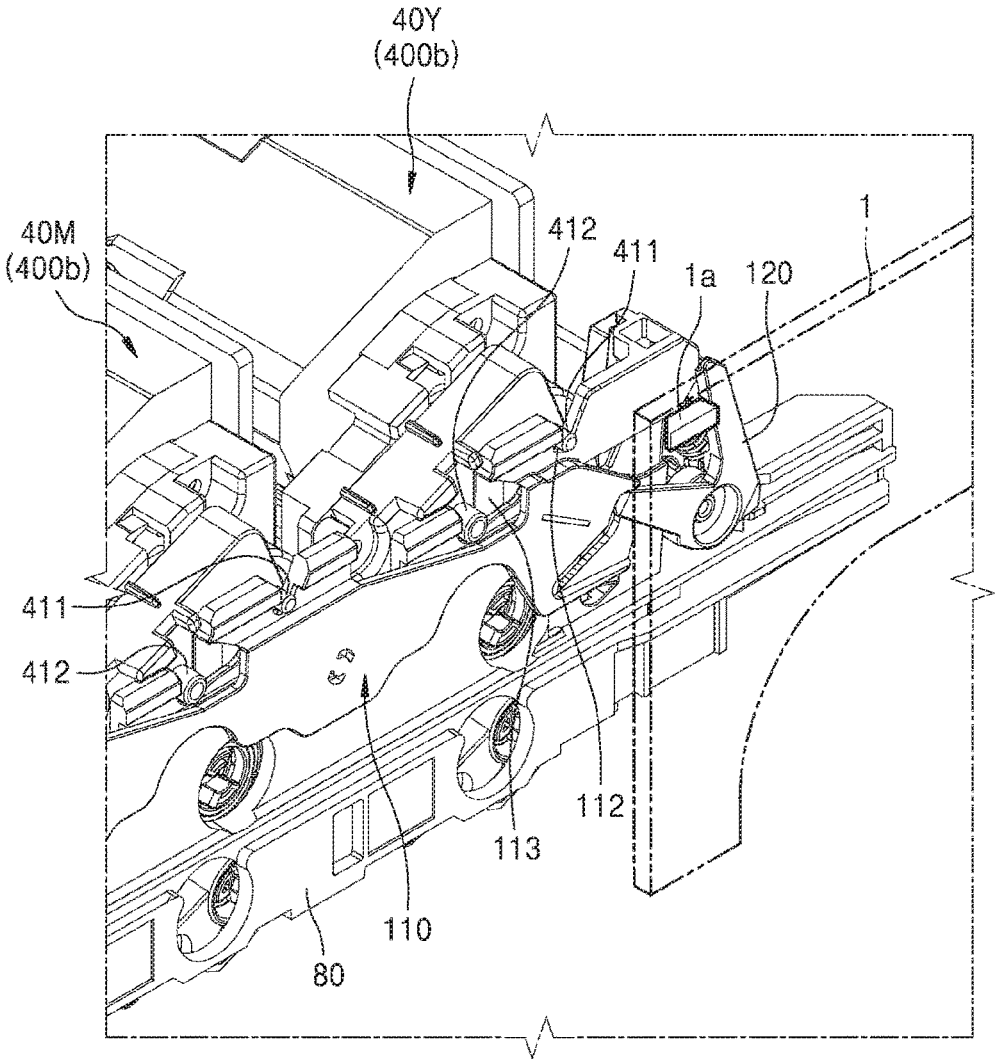
FIG. 8 illustrates a plurality of the developing units mounted on the tray in the developing unit transferring device of FIG. 5.

FIG. 8 illustrates the plurality of developing units 40Y, 40M, 40C, and 40K mounted on the tray 80. In FIG. 8, the position adjustment unit 110 has ascended with respect to the tray 80.

Referring to FIGS. 6B and 8, the position adjustment unit 110 includes support areas 112 that support the first protrusions 411 of the developing units 40Y, 40M, 40C, and 40K. The support areas 112 may be grooves into which the first protrusions 411 may be inserted. The developing units 40Y, 40M, 40C, and 40K may be rotatably supported by the support areas 112 of the position adjustment unit 110. The first protrusions 411 inserted into the support areas 112 may be supported by the support areas 112 without being shaken in the forward-backward direction (X direction).

The position adjustment unit 110 may include rotating angle restricting areas 113. The rotating angle restricting areas 113 restrict rotating angles of the developing units 40Y, 40M, 40C, and 40K, respectively. For example, when the developing units 40Y, 40M, 40C, and 40K are rotated, the rotating angle restricting areas 113 may contact the second protrusions 412 of the developing units 40Y, 40M, 40C, and 40K and restrict the rotating angles of the second protrusions 412.

Figure 9A:
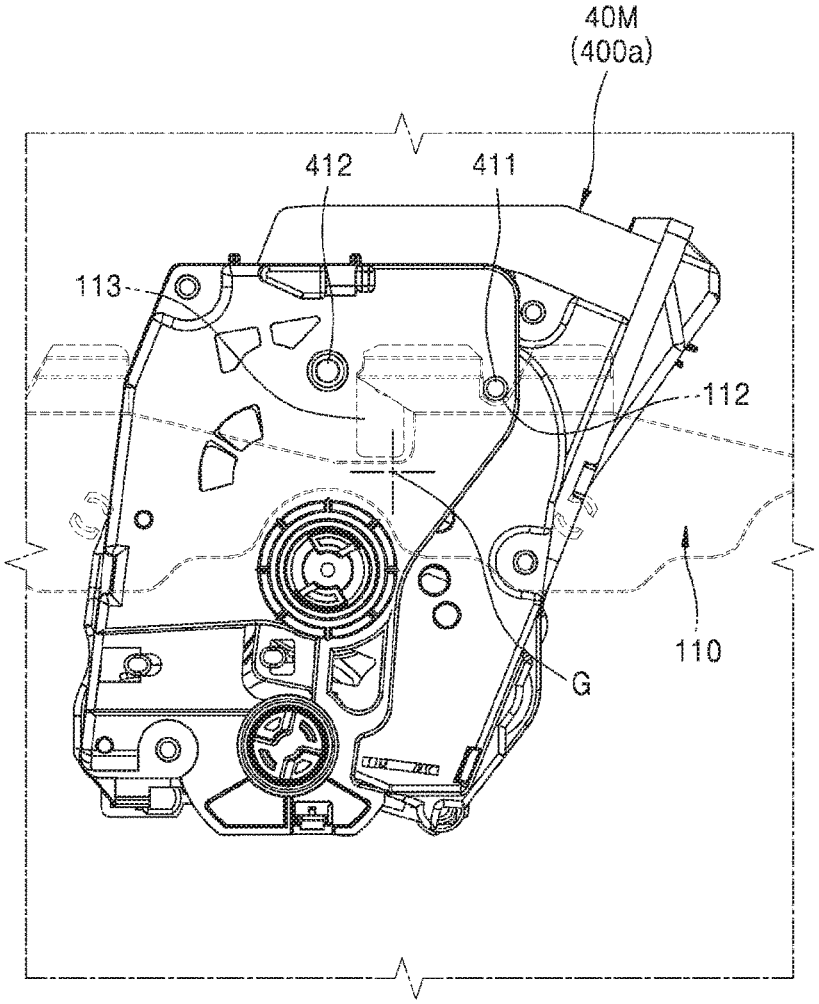
FIGS. 9A and 9B illustrate adjustment of a position of a developing unit by a position adjustment unit.
Figure 9B:
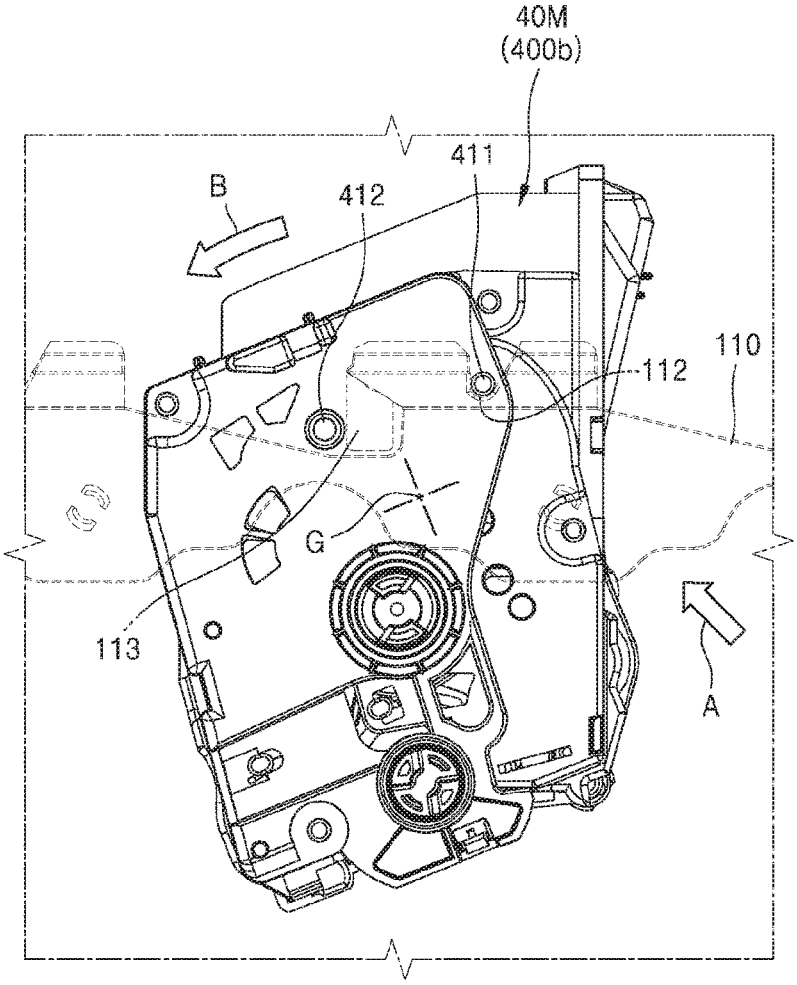

FIGS. 9A an 9B illustrate adjustment of positions of the developing units 40Y, 40M, 40C, and 40K by the position adjustment unit 110. In FIG. 9A, the position adjustment unit 110 has not yet been moved up with respect to the tray 80. In FIG. 9B, the position adjustment unit 110 has been moved up with respect to the tray 80. For convenience of explanation, FIGS. 9A and 9B focus on the developing unit 40M.

Referring to FIG. 9A, a support area 112 of the position adjustment unit 110 contacts and supports the first protrusion 411 of the developing unit 40M. Although not shown in FIGS. 9A and 9B, the second protrusion 412 of the developing unit 40M contacts the tray 80 and is supported by the tray 80.

Referring to FIG. 9B, as the position adjustment unit 110 ascends in an A direction, the first protrusion 411 supported by the support area 112 also ascends. At this time, because the first protrusion 411 is formed at a location offset from the center of gravity G, the developing unit 40M is rotated about the first protrusion 411 due to gravity. The developing unit 40M is rotated in a B direction based on the first protrusion 411 serving as a rotating axis due to load of the developing unit 40M. As the developing unit 40M rotates, the second protrusion 412 moves counterclockwise. The movement of the second protrusion 412 is interrupted by contact with the rotating angle restricting area 113.

As described above, when the position adjustment unit 110 moves up with respect to the tray 80, the developing unit 40M is changed or adjusted from the first position 400*a* to the second position 400*b* by the position adjustment unit 110. Thus, the plurality of developing units 40Y, 40M, 40C, and 40K are mounted on the tray 80 without being overlapped with each other. In this state, a user may separate or replace desired developing units 40Y, 40M, 40C, and 40K in a vertical direction.

A structure for applying an external force to the position adjustment unit 110 will now be described.

Figure 10:
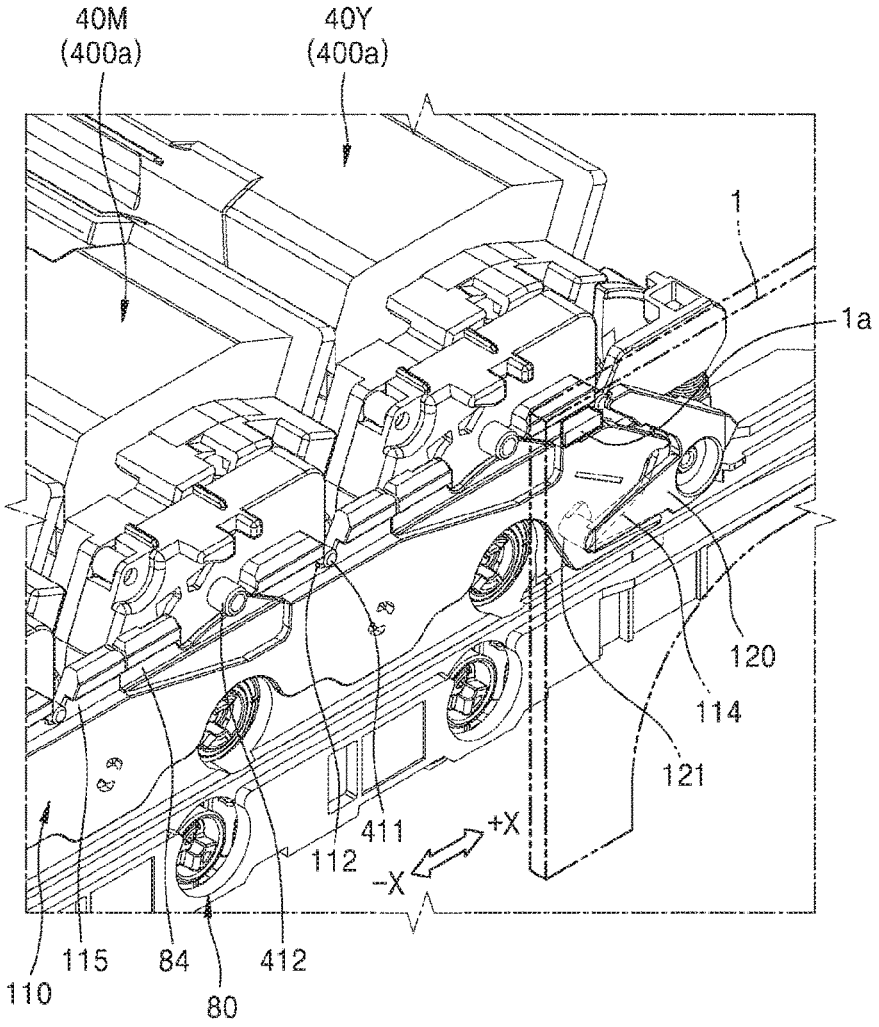
FIGS. 10 and 11 respectively illustrate an angle adjustment unit to which an external force has not yet been applied, and an angle adjustment unit to which an external force has been applied, in a developing unit transferring device according to an embodiment.
Figure 11:
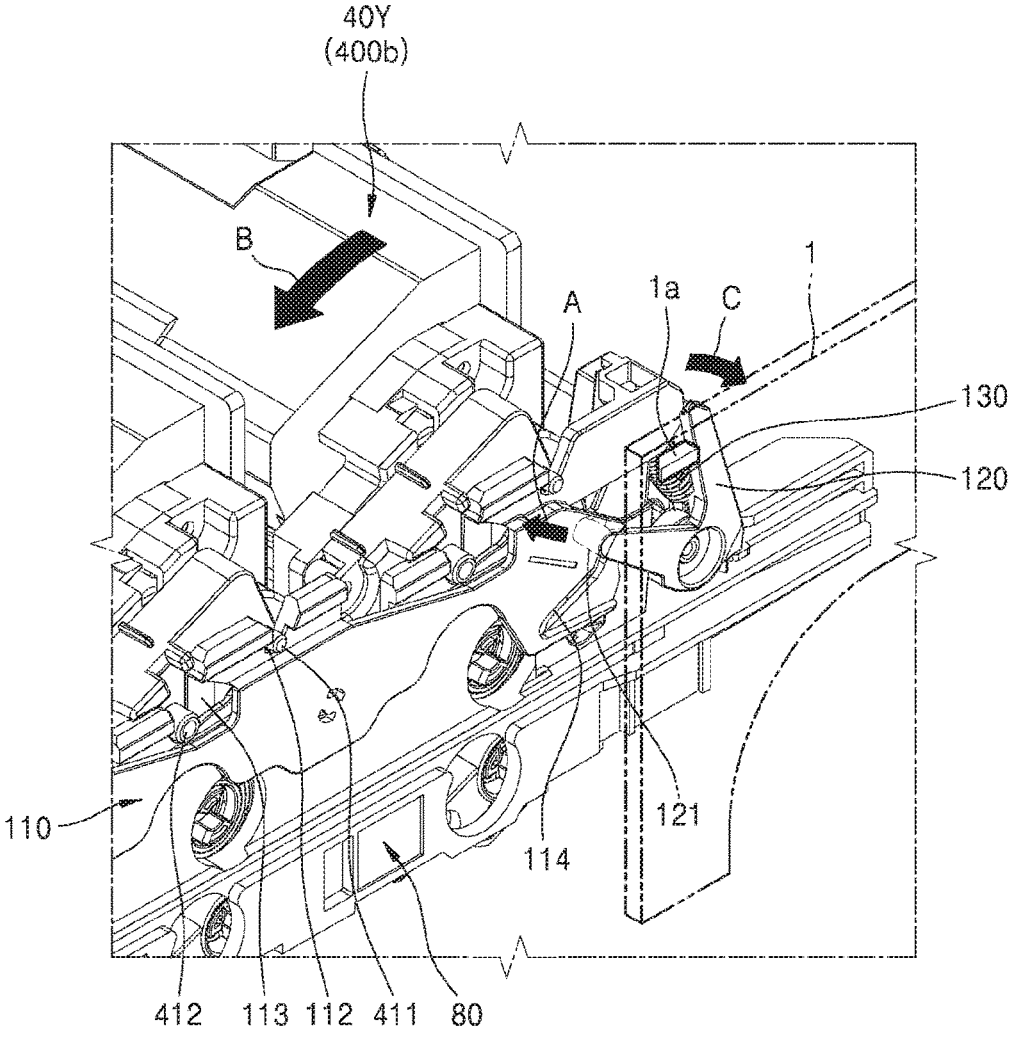

FIGS. 10 and 11 respectively illustrate the position adjustment unit 110 to which an external force has not yet been applied, and the position adjustment unit 110 to which an external force has been applied, in the developing unit transferring device 100 according to an embodiment.

Referring to FIGS. 6A and 10, a rotating member 120 rotatable with respect to the tray 80 is provided on the tray 80. The rotating member 120 may be arranged on one side of the tray 80 where the position adjustment unit 110 is provided.

The rotating member 120 may be connected to the position adjustment unit 110. For example, the rotating member 120 includes a protrusion 121 protruding toward the position adjustment unit 110, and the position adjustment unit 110 includes a guide hole 114 into which the protrusion 121 is inserted and which guides the protrusion 121 to move.

The position adjustment unit 110 may move with rotation of the rotating member 120. For example, while the rotating member 120 is rotating, the protrusion 121 of the rotating member 120 applies an external force to the position adjustment unit 110 by moving along the guide hole 114 of the position adjustment unit 110. Due to the external force applied by the protrusion 121 of the rotating member 120, the position adjustment unit 110 moves with respect to the tray 80. For example, the position adjustment unit 110 ascends with respect to the tray 80.

An interfering member 1*a* protruding toward the tray 80 is arranged on the body 1. Because the interfering member 1*a* is fixed to the body 1, while the tray 80 is being withdrawn in the rear direction (−X direction), the rotating member 120 arranged on the tray 80 may contact the interfering member 1*a*.

Referring to FIG. 11, when the rotating member 120 is in contact with the interfering member 1*a* and the tray 80 is further withdrawn in the rear direction (−X direction), the rotating member 120 is pressed by the interfering member 1*a* and is rotated in a clockwise direction (C direction).

As the rotating member 120 rotates in the clockwise direction (C direction), the protrusion 121 of the rotating member 120 applies a pressure to the position adjustment unit 110 while moving along the guide holes 114 of the position adjustment unit 110. Accordingly, the position adjustment unit 110 ascends at an angle to the forward-backward direction (X direction).

As the position adjustment unit 110 ascends, the first protrusions 411 of the developing units 40Y, 40M, 40C, and 40K supported by the support areas 112 of the position adjustment unit 110 ascend. Because the first protrusions 411 are arranged at locations that deviate from the developing units 40Y, 40M, 40C, and 40K, the developing units 40Y, 40M, 40C, and 40K rotate counterclockwise, for example, in a B direction, as the first protrusions 411 ascend. Accordingly, the second protrusions 412 are rotated about the first protrusions 411. The second protrusions 412 are each rotated by a predetermined angle by the rotating angle restricting areas 113, and are then stopped. Accordingly, each of the developing units 40Y, 40M, 40C, and 40K is rotated by a predetermined angle. For example, to prevent overlap between the plurality of developing units 40Y, 40M, 40C, and 40K, the plurality of developing units 40Y, 40M, 40C, and 40K are rotated to have the second positions 400*b*.

In such a state as FIG. 11, when replacements of the developing units 40Y, 40M, 40C, and 40K are completed and then the developing units 40Y, 40M, 40C, and 40K are mounted within the body 1, the mounting is performed in a reverse order to the above-described order. For example, when a new developing unit is mounted on the tray 80 and then, the tray 80 is inserted into the body 1 in the front direction (+X direction), the tray 80 is moved in the front direction (+X direction), and accordingly the pressing of the rotating member 120 by the interfering member 1*a* is released.

An elastic member 130 is arranged between the position adjustment unit 110 and the tray 80. The elastic member 130 provides an elastic bias to the position adjustment unit 110 so that the position adjustment unit 110 descends. When the pressing of the rotating member 120 by the interfering member 1*a* is released, the position adjustment unit 110 may be restored to its original location. The rotating member 120 connected to the position adjustment unit 110 also rotates counterclockwise and is thus restored to its original location. The plurality of developing units 40Y, 40M, 40C, and 40K rotate clockwise about the first protrusions 411 and overlap each other.

According to an embodiment, although not shown in the drawings, the elastic member 130 may be disposed between the rotating member 120 and the tray 80. Accordingly, when the pressing of the rotating member 120 by the interfering member 1*a* is released, the rotating member 120 is rotated counterclockwise, and thus the position adjustment unit 110 may be restored to its original location.

Referring to FIGS. 6A and 10, the tray 80 and the position adjustment unit 110 include guide rails 84 and 115, respectively, extending in the forward-backward direction. The guide rail 84 of the tray 80 is connected to the guide rail 115 of the position adjustment unit 110 in the forward-backward direction (X direction).

The interfering member 1*a* may be inserted into the guide rails 84 and 115. As the interfering member 1*a* is inserted into the guide rails 84 and 115 and the tray 80 is withdrawn in the rear direction (−X direction), the tray 80, and the position adjustment unit 110 and the rotating member 120 provided on the tray 80 move with respect to the interfering member 1*a* in the rear direction (−X direction).

The rotating member 120 may be arranged on a lateral surface of the tray 80 in the forward direction (+X direction). Accordingly, while the tray 80 is being moved in the rear direction (−X direction), the rotating member 120 first approaches the interfering member 1*a* without contacting the interfering member 1*a*. When or after the plurality of developing units 40Y, 40M, 40C, and 40K mounted on the tray 80 are exposed to outside the body 1, the rotating member 120 may contact the interfering member 1*a* and may be pressed by the interfering member 1*a*.

Figure 12:
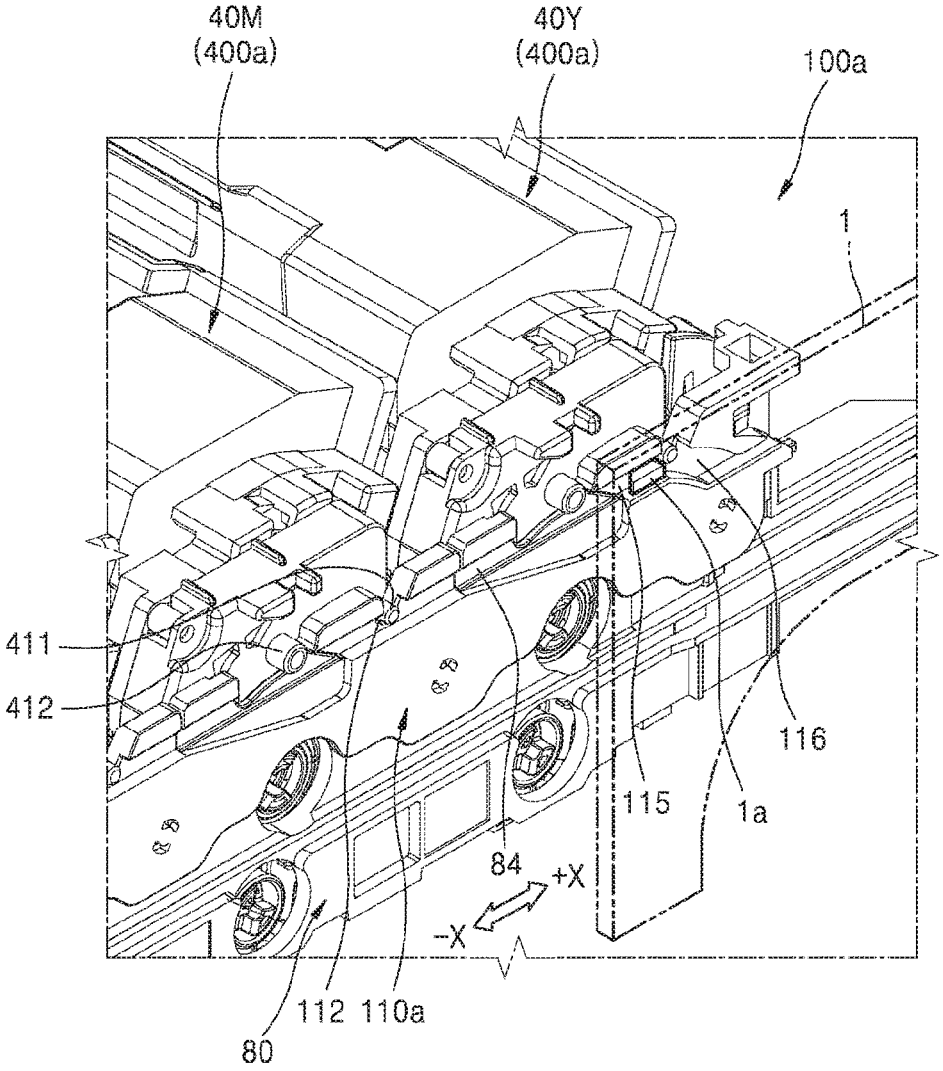
FIGS. 12 and 13 respectively illustrate an angle adjustment unit to which an external force has not yet been applied, and an angle adjustment unit to which an external force has been applied, in a developing unit transferring device according to an embodiment.
Figure 13:
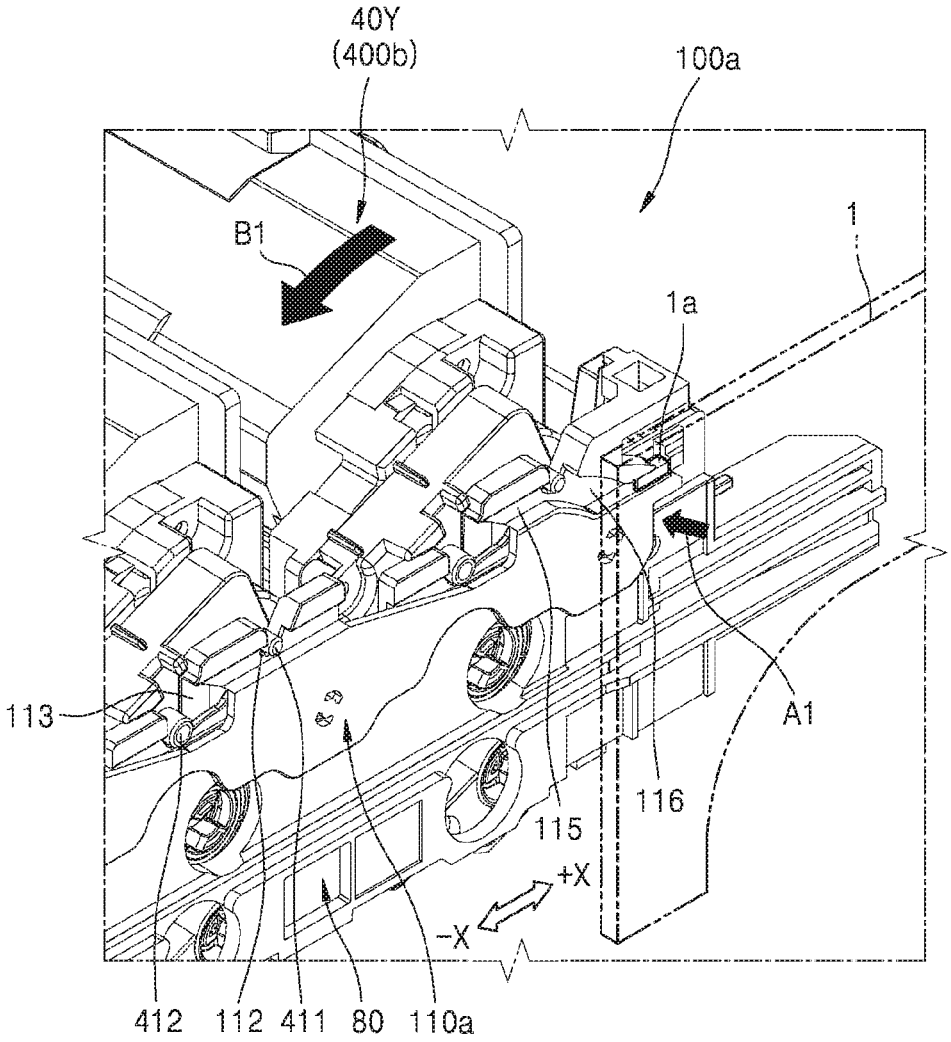

FIGS. 12 and 13 respectively illustrate a position adjustment unit 110*a* to which an external force has not yet been applied, and a position adjustment unit 110*a* to which an external force has been applied, in a developing unit transferring device 100*a* according to an embodiment. The developing unit transferring device 100*a* of FIGS. 12 and 13 has the same structure as the developing unit transferring device 100 except that an external force is applied to the position adjustment unit 110*a*. The same structure as the developing unit transferring device 100 uses the same reference numeral, and a redundant description thereof will be omitted here.

Referring to FIGS. 12 and 13, the developing unit transferring device 100*a* may include a second guide rail 116 (inclined rail) formed on an exterior surface of the position adjustment unit 110*a*. The second guide rail 116 may extend at an angle to the forward-backward direction (X direction).

The second guide rail 116 may be connected to a guide rail 115 of the position adjustment unit 110*a* or the guide rail 84 of the tray 80. For example, the second guide rail 116 may extend from the guide rail 115 of the position adjustment unit 110*a*.

While the tray 80 is being withdrawn in the rear direction (−X direction), the interfering member 1*a* is first inserted into the guide rails 84 and 115 of the tray 80 and the position adjustment unit 110*a*, and is then inserted into the second guide rail 116 of the position adjustment unit 110*a*.

When the interfering member 1*a* is inserted into the guide rail 84 of the tray 80 or the guide rail 115 of the position adjustment unit 110*a* and the tray 80 is withdrawn in the rear direction (−X direction), both the tray 80 and the position adjustment unit 110*a* disposed on the tray 80 move in the rear direction (−X direction).

On the other hand, when the interfering member 1*a* is inserted into the second guide rail 116 of the position adjustment unit 110*a* and the tray 80 is withdrawn in the rear direction (−X direction), because the second guide rail 116 of the position adjustment unit 110*a* extends at an angle to the forward-backward direction (X direction), the position adjustment unit 110*a* is pressed by the interfering member 1*a* at an angle to the forward-backward direction (X direction). At this time, because the tray 80 does not contact the interfering member 1*a*, the tray 80 is not pressed by the interfering member 1*a*. Accordingly, the tray 80 moves in the rear direction (−X direction), which is the leading-out direction, and the position adjustment unit 110*a* ascends in an A1 direction that is inclined with respect to the forward-backward direction (X direction). Accordingly, the position adjustment unit 110*a* ascends with respect to the tray 80.

As the position adjustment unit 110*a* ascends in the A1 direction, the developing units 40Y, 40M, 40C, and 40K are rotated about the first protrusions 411 counterclockwise, namely, in a B1 direction. Accordingly, the second protrusions 412 are rotated about the first protrusions 411. The second protrusions 412 are each rotated by a predetermined angle by the rotating angle restricting areas 113, and are then stopped. Accordingly, each of the developing units 40Y, 40M, 40C, and 40K is rotated by a predetermined angle. For example, to prevent overlap between the plurality of developing units 40Y, 40M, 40C, and 40K, the plurality of developing units 40Y, 40M, 40C, and 40K are rotated to have the second positions 400*b*.

When the position adjustment unit 110*a* is raised as shown in FIG. 13 and the tray 80 is inserted in the front direction (+X direction), the second guide rail 116 of the position adjustment unit 110*a* is pressed and descended by the interfering member 1*a*. Accordingly, the plurality of developing units 40Y, 40M, 40C, and 40K are rotated clockwise about the first protrusions 411 and overlap each other. According to the present embodiment, in the movement direction of the tray 80, the position adjustment unit 110*a* is ascended or descended by the second guide rail 116, and thus the elastic member 130 of FIG. 10 may not be included.

Figure 14:
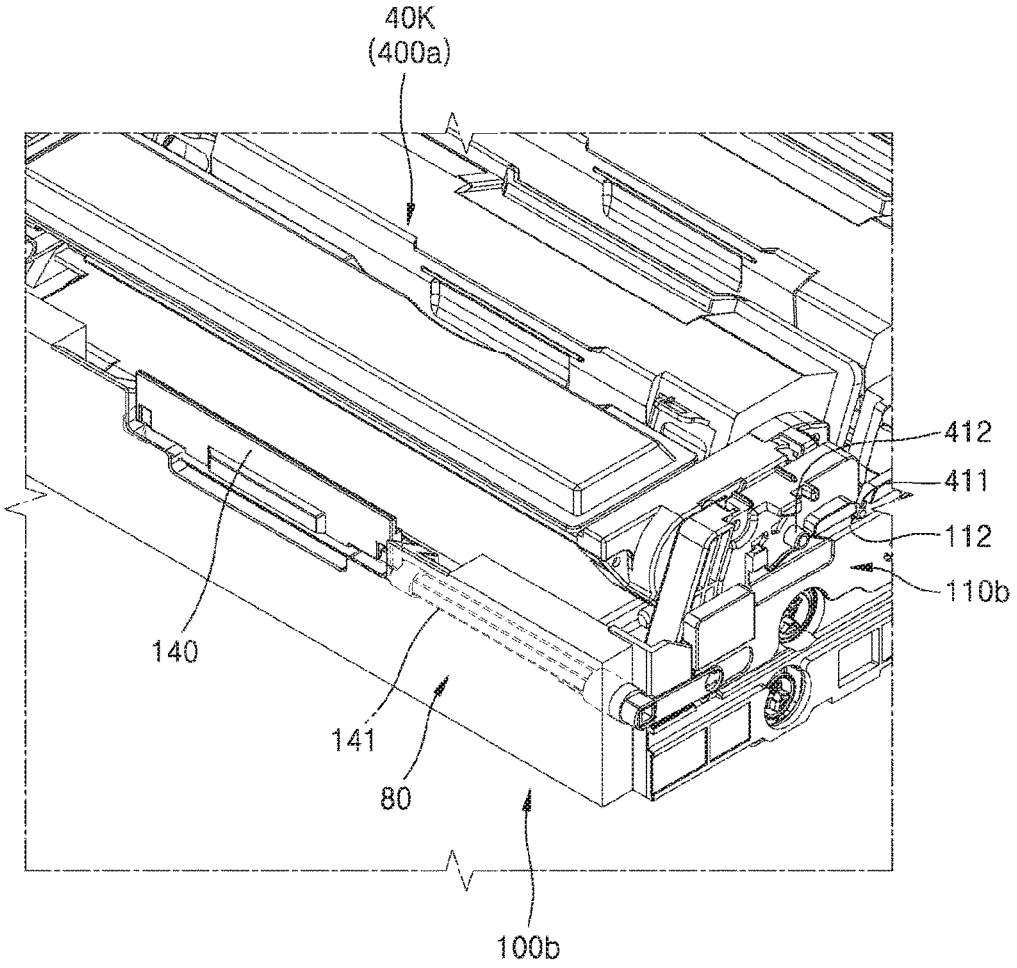
FIGS. 14 and 15 respectively illustrate an angle adjustment unit to which an external force has not yet been applied, and an angle adjustment unit to which an external force has been applied, in a developing unit transferring device according to an embodiment.
Figure 15:
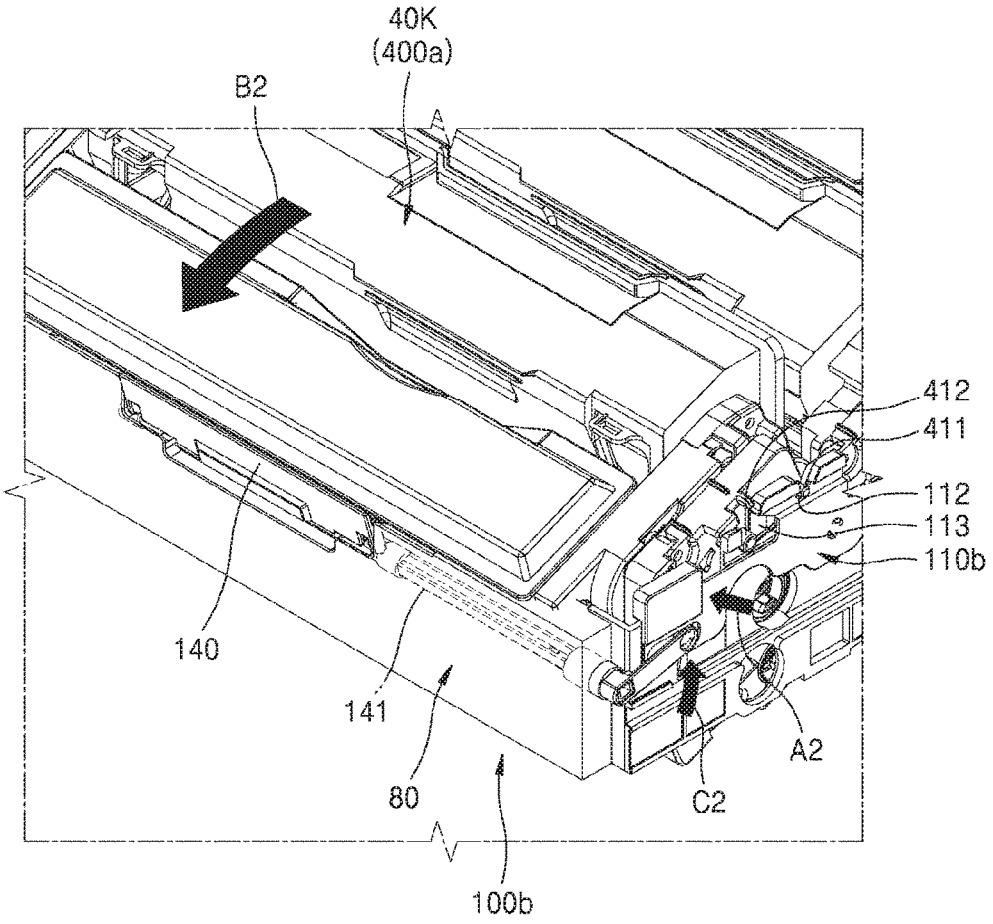

FIGS. 14 and 15 respectively illustrate a position adjustment unit 110*b* to which an external force has not yet been applied, and a position adjustment unit 110*b* to which an external force has been applied, in a developing unit transferring device 100*b* according to an embodiment. The developing unit transferring device 100*b* of FIGS. 14 and 15 has the same structure as the developing unit transferring devices 100 and 100*a* except that an external force is applied to the position adjustment unit 110*b*. The same structure as the developing unit transferring devices 100 and 100*a* uses the same reference numeral, and a redundant description thereof will be omitted here.

Referring to FIGS. 14 and 15, the developing unit transferring device 100*b* includes a handle unit 140 provided on the tray 80. The handle unit 140 may be disposed at the rear of the tray 80. A connection link 141 is provided between the handle unit 140 and the position adjustment unit 110*b* and connects the handle unit 140 and the position adjustment unit 110*b* to each other.

While or after a user moves the tray 80 to the second position 800*b*, the positions of the developing units 40Y, 40M, 40C, and 40K may be adjusted via the handle unit 140 provided on the tray 80.

For example, as the user pulls out the handle unit 140, the connection link 141 rotates about a predetermined rotating axis clockwise, for example, in a C2 direction. Due to the rotation of the connection link 141, the position adjustment unit 110*b* is pressed and ascends in an A2 direction. Due to the ascending of the position adjustment unit 110*b*, the developing units 40Y, 40M, 40C, and 40K are rotated about the first protrusions 411 counterclockwise, namely, in a B2 direction. Accordingly, the second protrusions 412 are rotated about the first protrusions 411. The second protrusions 412 are each rotated by a predetermined angle by the rotating angle restricting areas 113 and are then stopped. Accordingly, each of the developing units 40Y, 40M, 40C, and 40K is rotated by a predetermined angle. For example, to prevent overlap between the plurality of developing units 40Y, 40M, 40C, and 40K, the plurality of developing units 40Y, 40M, 40C, and 40K are rotated to have the second positions 400*b*.

When the position adjustment unit 110*b* is raised as shown in FIG. 15 and the user pushes the handle unit 140, the connection link 141 is rotated clockwise, and the position adjustment unit 110*b* descends. As the position adjustment unit 110*b* descends, the plurality of developing units 40Y, 40M, 40C, and 40K rotate about the first protrusions 411 clockwise and overlap each other.

According to a developing unit separating device, an image forming apparatus employing the same, and a developing unit separating method performed by the image forming apparatus according to an embodiment, the toner capacity of a developing unit increases without enlarging the image forming apparatus, and the developing unit may be easily replaced.

While the inventive concept has been particularly shown and described with reference to exemplary embodiments thereof, it will be understood by those of ordinary skill in the art that various changes in form and details may be made therein without departing from the spirit and scope as defined by the following claims.

What is claimed is:

1. An image forming apparatus comprising:

a body;

a tray to receive a plurality of developing units mountable thereon, the plurality of developing units including a frontmost developing unit mountable at a first location adjacent to a front of the tray and a rearmost developing unit mountable at a second location adjacent to a rear of the tray, and the tray being movable to a first tray position at which the tray is inside the body and a second tray position at which at least a portion of the tray is outside the body; and a position adjustment unit, disposed on at least one side of the tray and movable with respect to the tray, to rotatably support the plurality of developing units, wherein, when the position adjustment unit is moved upward with respect to the tray as the tray is moved rearward to the second tray position, the plurality of developing units are rotated through contact with the position adjustment unit during the upward movement of the position adjustment unit, at a time the plurality of developing units are outside the body.

2. The image forming apparatus of claim 1, wherein, when the tray is located at the first tray position, each of the plurality of developing units is in a first position where at least one of the plurality of developing units partially overlaps at least one other developing unit in the plurality of developing units.

3. The image forming apparatus of claim 2, wherein each of the plurality of developing units comprises a toner containing unit, and when the plurality of developing units are in the first position, a partial region of at least one of the toner containing units is disposed over an adjacent developing unit in the plurality of developing units.

4. The image forming apparatus of claim 1, wherein, when the tray is located at the second tray position, the plurality of developing units have been rotated by the position adjustment unit, and the plurality of developing units are in second positions where the plurality of developing units are individually removable from the tray.

5. The image forming apparatus of claim 1, wherein each of the plurality of developing units comprises a first protrusion provided on a lateral surface that faces the position adjustment unit and positioned at a location that is offset from a center of gravity of each of the plurality of developing units, and the position adjustment unit comprises a support area that contacts and supports the first protrusion.

6. The image forming apparatus of claim 1, wherein the body further comprises an interfering member that protrudes toward the tray.

7. The image forming apparatus of claim 6, wherein the position adjustment unit further comprises an inclined rail that extends at an angle in a movement direction of the tray and into which the interfering member is insertable.

8. An image forming apparatus, comprising:

a body;

a tray to receive a plurality of developing units mountable thereon, the plurality of developing units including a frontmost developing unit mountable at a first location adjacent to a front of the tray and a rearmost developing unit mountable at a second location adjacent to a rear of the tray, and the tray being movable to a first tray position at which the tray is inside the body and a second tray position at which at least a portion of the tray is outside the body; and a position adjustment unit, disposed on at least one side of the tray and movable with respect to the tray, to rotatably support the plurality of developing units, wherein as the position adjustment unit is moved upward with respect to the tray at a time the plurality of developing units are outside the body, the plurality of developing units are rotated by the position adjustment unit through contact with the position adjustment unit during the upward movement of the position adjustment unit, each of the plurality of developing units comprises:

a first protrusion provided on a lateral surface that faces the position adjustment unit and positioned at a location that is offset from a center of gravity of each of the plurality of developing units, and a second protrusion provided on the lateral surface that faces the position adjustment unit and positioned at a location away from the first protrusion, and the position adjustment unit comprises:

a support area that contacts and supports the first protrusion, and a rotating angle restricting area that restricts a rotating angle of the second protrusion.

9. An image forming apparatus, comprising:

a body;

a tray to receive a plurality of developing units mountable thereon, the plurality of developing units including a frontmost developing unit mountable at a first location adjacent to a front of the tray and a rearmost developing unit mountable at a second location adjacent to a rear of the tray, and the tray being movable to a first tray position at which the tray is inside the body and a second tray position at which at least a portion of the tray is outside the body; and a position adjustment unit, disposed on at least one side of the tray and movable with respect to the tray, to rotatably support the plurality of developing units, wherein as the position adjustment unit is moved upward with respect to the tray at a time the plurality of developing units are outside the body, the plurality of developing units are rotated by the position adjustment unit through contact with the position adjustment unit during the upward movement of the position adjustment unit, one of the tray and the position adjustment unit comprises a guide hole that extends at an angle in a movement direction of the tray, and the other of the tray and the position adjustment unit comprises a guide protrusion that is insertable into the guide hole.

10. An image forming apparatus comprising:

a body;

a tray to receive a plurality of developing units mountable thereon, the tray being movable to a first tray position at which the tray is inside the body and a second tray position at which at least a portion of the tray is outside the body; and a position adjustment unit, disposed on at least one side of the tray and movable with respect to the tray, to rotatably support the plurality of developing units, wherein as the position adjustment unit is moved with respect to the tray, the plurality of developing units are rotated by the position adjustment unit, the body comprises an interfering member that protrudes toward the tray, the tray comprises a rotating member that is pressed and rotated by the interfering member while the tray is moving from the first tray position to the second tray position, and the position adjustment unit is moved from a first adjustment position with respect to the tray in connection with the rotating member.

11. The image forming apparatus of claim 10, further comprising an elastic member that restores the position adjustment unit to the first adjustment position, when the pressing of the rotating member by the interfering member is released.

12. An image forming apparatus, comprising:

a body;

a tray to receive a plurality of developing units mountable thereon, the tray being movable to a first tray position at which the tray is inside the body and a second tray position at which at least a portion of the tray is outside the body;

a position adjustment unit, disposed on at least one side of the tray and movable with respect to the tray, to rotatably support the plurality of developing units; and a handle unit rotatably provided on the tray, wherein the position adjustment unit is moved with respect to the tray in connection with a rotation of the handle unit, and as the position adjustment unit is moved with respect to the tray, the plurality of developing units are rotated by the position adjustment unit.

13. A developing unit transferring device of an image forming apparatus, comprising:

a tray to receive a plurality of developing units mountable thereon, the plurality of developing units including a frontmost developing unit mountable at a first location adjacent to a front of the tray and a rearmost developing unit mountable at a second location adjacent to a rear of the tray, and the tray being movable to a first tray position at which the tray is inside a body of the image forming apparatus and a second tray position at which at least a portion of the tray is outside the body; and a position adjustment unit, disposed on at least one side of the tray and movable with respect to the tray, to rotatably support the plurality of developing units, wherein, when the position adjustment unit is moved upward with respect to the tray as the tray is moved rearward to the second tray position at a time the plurality of developing units are outside the body, the plurality of developing units are rotated by the position adjustment unit through contact with the position adjustment unit during the upward movement of the position adjustment unit.

14. The developing unit transferring device of claim 13, wherein, when the tray is located at the first tray position, each of the plurality of developing units is in a first position where at least one of the plurality of developing units partially overlaps at least one other developing unit in the plurality of developing units.

15. The developing unit transferring device of claim 13, wherein, when the tray is located at the second tray position, the plurality of developing units have been rotated by the position adjustment unit, and the plurality of developing units are in second positions where the plurality of developing units are individually removable from the tray.

16. The developing unit transferring device of claim 13, wherein each of the plurality of developing units comprises a first protrusion provided on a lateral surface that faces the position adjustment unit and positioned at a location that is offset from a center of gravity of each of the plurality of developing units, and the position adjustment unit comprises a support area that contacts and supports the first protrusion.

17. A developing unit transferring device, comprising:

a tray to receive a plurality of developing units mountable thereon, and the tray being movable to a first tray position at which the tray is inside a body of the image forming apparatus and a second tray position at which at least a portion of the tray is outside the body; and a position adjustment unit, disposed on at least one side of the tray and movable with respect to the tray, to rotatably support the plurality of developing units, wherein as the position adjustment unit is moved with respect to the tray, the plurality of developing units are rotated by the position adjustment unit, each of the plurality of developing units comprises:

a first protrusion provided on a lateral surface that faces the position adjustment unit and positioned at a location that is offset from a center of gravity of each of the plurality of developing units, and a second protrusion provided on the lateral surface that faces the position adjustment unit and positioned at a location away from the first protrusion, and the position adjustment unit comprises:

a support area that contacts and supports the first protrusion, and a rotating angle restricting area that restricts a rotating angle of the second protrusion.

18. A developing unit separating method of an image forming apparatus, the developing unit separating method comprising:

withdrawing a tray in a rearward direction from a body of the image forming apparatus, the tray including a plurality of developing units mountable thereon, and the plurality of developing units including a frontmost developing unit mountable at a first location adjacent to a front of the tray and a rearmost developing unit mountable at a second location adjacent to a rear of the tray;

moving a position adjustment unit, that is disposed on at least one side of the tray and to rotatably support the plurality of developing units, in an upward direction with respect to the tray;

adjusting positions of the plurality of developing units, at a time the plurality of developing units are outside the body, by rotating the plurality of developing units through the position adjustment unit contacting the plurality of developing units during the upward movement of the position adjustment unit; and individually separating at least one of the position-adjusted developing units from the tray.

19. The developing unit separating method of claim 18, wherein, before the adjusting of the positions of the plurality of developing units, the plurality of developing units mounted on the tray partially overlap each other.

20. The developing unit separating method of claim 19, wherein, in the adjusting of the positions of the plurality of developing units, the plurality of developing units are rotated such that the plurality of developing units are individually separable from the tray.

* * * * *